US009972282B2

(12) United States Patent
Yamamoto et al.

(10) Patent No.: US 9,972,282 B2
(45) Date of Patent: May 15, 2018

(54) ELECTROLUMINESCENT DISPLAY PANEL AND ELECTRONIC DEVICE

(71) Applicant: Sony Corporation, Tokyo (JP)

(72) Inventors: Tetsuro Yamamoto, Kanagawa (JP); Katsuhide Uchino, Kanagawa (JP); Masakazu Kato, Kanagawa (JP)

(73) Assignee: Sony Corporation, Tokyo (JP)

( * ) Notice: Subject to any disclaimer, the term of this patent is extended or adjusted under 35 U.S.C. 154(b) by 621 days.

(21) Appl. No.: 14/450,801

(22) Filed: Aug. 4, 2014

(65) Prior Publication Data

US 2014/0340378 A1 Nov. 20, 2014

Related U.S. Application Data

(63) Continuation of application No. 12/289,875, filed on Nov. 6, 2008.

(30) Foreign Application Priority Data

Nov. 9, 2007 (JP) ..... 2007-291471

(51) Int. Cl.
*G09G 5/18* (2006.01)
*G09G 3/3233* (2016.01)
(Continued)

(52) U.S. Cl.
CPC ..... *G09G 5/18* (2013.01); *G09G 3/3233* (2013.01); *G09G 3/3266* (2013.01);
(Continued)

(58) Field of Classification Search
None
See application file for complete search history.

(56) References Cited

U.S. PATENT DOCUMENTS 5,113,096 A * 5/1992 Lev ..... H03K 19/09448 326/110
5,898,206 A * 4/1999 Yamamoto ..... H01L 27/027 257/360
(Continued)

FOREIGN PATENT DOCUMENTS

JP 10-253940 9/1998
JP 2005-181920 A 7/2001
(Continued)

OTHER PUBLICATIONS

Japanese Office Action dated Jul. 8, 2014 for corresponding Japanese Application No. 2012-259394.
(Continued)

*Primary Examiner* — Jose Soto Lopez
(74) *Attorney, Agent, or Firm* — Michael Best & Friedrich LLP

(57) ABSTRACT

An EL display panel including: a pixel array section in which EL display elements whose light emission state is controlled by an active matrix driving system are arranged in a form of a matrix; a first writing control line driving section and a second writing control line driving section configured to drive each writing control line from both sides of the pixel array section; and a first power supply line driving section and a second power supply line driving section configured to drive a power supply line disposed along a direction of a horizontal line from both sides of the pixel array section, the first power supply line driving section and the second power supply line driving section being respectively arranged between the first writing control line driving section and the pixel array section and between the second writing control line driving section and the pixel array section.

20 Claims, 33 Drawing Sheets

(51) Int. Cl.
*G09G 3/3266* (2016.01)
*G09G 3/36* (2006.01)

(52) U.S. Cl.
CPC ... *G09G 3/3696* (2013.01); *G09G 2300/0819* (2013.01); *G09G 2300/0842* (2013.01); *G09G 2300/0866* (2013.01); *G09G 2310/0281* (2013.01); *G09G 2310/0291* (2013.01); *G09G 2320/0223* (2013.01); *G09G 2320/043* (2013.01)

(56) References Cited

U.S. PATENT DOCUMENTS 6,054,893 A * 4/2000 Singh ..... G11C 17/16 327/525
6,504,520 B1 1/2003 Osada et al.
6,552,768 B1 * 4/2003 Matsuda ..... G02F 1/13454 349/151
6,753,217 B2 * 6/2004 Gudesen ..... H01L 21/823418 257/E21.619
7,057,588 B2 6/2006 Asano et al.
7,102,202 B2 9/2006 Kobayashi et al.
7,109,952 B2 9/2006 Kwon
7,173,590 B2 * 2/2007 Uchino ..... G09G 3/2011 345/104
2001/0022565 A1 * 9/2001 Kimura ..... G09G 3/3266 345/82
2001/0035849 A1 * 11/2001 Kimura ..... G09G 3/2022 345/76
2001/0040565 A1 * 11/2001 Koyama ..... G09G 3/006 345/204
2002/0075254 A1 * 6/2002 Anzai ..... G09G 3/3233 345/211
2003/0067458 A1 * 4/2003 Anzai ..... G09G 3/3225 345/204
2004/0061694 A1 * 4/2004 Noguchi ..... G09G 3/3233 345/204
2004/0100203 A1 5/2004 Kobayashi et al.
2004/0179005 A1 9/2004 Jo
2004/0256620 A1 * 12/2004 Yamazaki et al. ..... 257/66
2005/0057193 A1 * 3/2005 Ono ..... G09G 3/006 315/291
2005/0062686 A1 * 3/2005 Iguchi ..... G09G 3/3233 345/46
2005/0127357 A1 6/2005 Wong et al.
2005/0206590 A1 9/2005 Sasaki et al.
2006/0114200 A1 * 6/2006 Yamashita ..... G09G 3/3233 345/77
2006/0158095 A1 * 7/2006 Imamura ..... 313/500
2006/0170628 A1 * 8/2006 Yamashita ..... G09G 3/3233 345/76
2007/0013629 A1 * 1/2007 Matsumoto ..... H01L 27/3276 345/92
2007/0024547 A1 * 2/2007 Jang ..... G09G 3/3233 345/81
2007/0115225 A1 * 5/2007 Uchino ..... G09G 3/3233 345/76

FOREIGN PATENT DOCUMENTS

JP 2001-324958 A 11/2001
JP 2002-108310 A 4/2002
JP 2003-243657 A 8/2003
JP 2003-255856 A 9/2003
JP 2003-271095 A 9/2003
JP 2004-029791 A 1/2004
JP 2004-093682 A 3/2004
JP 2004-133240 A 4/2004
JP 2004-354742 A 12/2004
JP 2005-070614 A 3/2005
JP 2005-084119 A 3/2005
JP 2005-258326 A 9/2005
JP 2007-213042 A 8/2007
JP 2013-080237 A 5/2013
JP 5682612 1/2015

OTHER PUBLICATIONS

Korean Office Action dated Aug. 25, 2014 for corresponding Korean Application No. 10-2008-105642.
Japanese Office Action dated Mar. 13, 2012 for the corresponding Japanese Application No. 2007-291471.
Japanese Office Action dated Oct. 23, 2012 for corresponding Japanese Application No. 2007-291471.
Japanese Office Action dated Sep. 3, 2013 for corresponding Japanese Application No. 2012-259394.
Japanese Office Action dated Nov. 4, 2015 for corresponding Japanese Application No. 2014-206327.

* cited by examiner

POTENTIAL WAVEFORM NEAR WRITING CONTROL LINE DRIVING SECTION

POTENTIAL WAVEFORM DISTANT FROM WRITING CONTROL LINE DRIVING SECTION

257

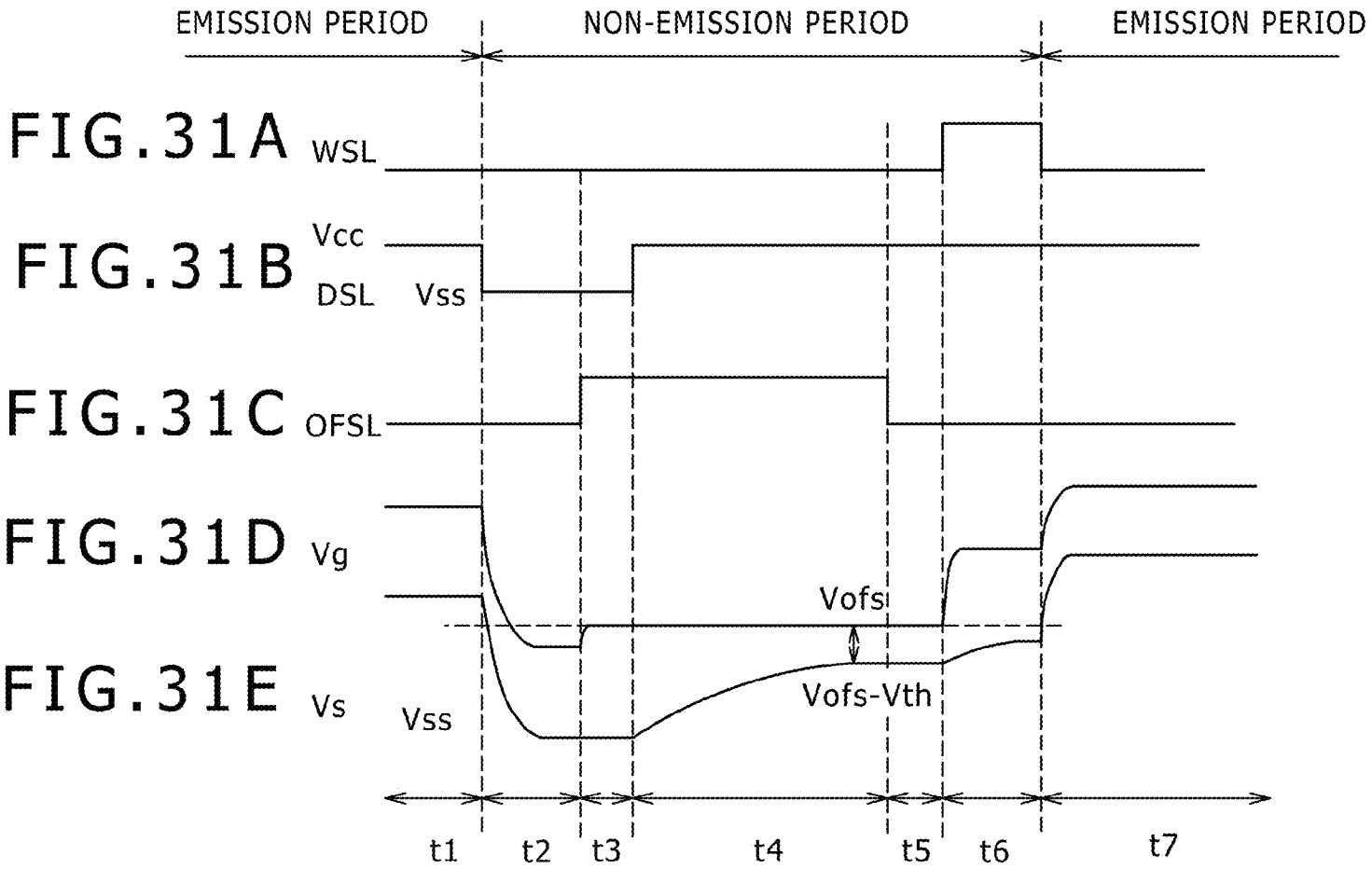
EMISSION PERIOD
NON-EMISSION PERIOD
EMISSION PERIOD
FIG.31A WSL
FIG.31B Vcc DSL Vss
FIG.31C OFSL
FIG.31D Vg
FIG.31E Vs Vss
Vofs
Vofs-Vth
t1
t2
t3
t4
t5
t6
t7

101

131

ELECTROLUMINESCENT DISPLAY PANEL AND ELECTRONIC DEVICE

CROSS REFERENCES TO RELATED APPLICATIONS

This is a Continuation of application Ser. No. 12/289,875, filed on Nov. 6, 2008, which contains subject matter related to Japanese Patent Application JP 2007-291471, filed in the Japan Patent Office on Nov. 9, 2007, the entire contents of which being incorporated herein by reference.

BACKGROUND OF THE INVENTION

1. Field of the Invention

The invention described in the present specification relates to a panel structure of an electroluminescent (EL) display panel driven and controlled by an active matrix driving system. Incidentally, the invention proposed in the present specification has an aspect as an electronic device including the EL display panel.

2. Description of the Related Art

FIG. 1 shows a circuit block configuration typical of an organic EL panel of an active matrix driving type. As shown in FIG. 1, the organic EL panel 1 includes a pixel array section 3, a writing control line driving section 5 as a driving circuit for driving the pixel array section 3, and a horizontal selector 7. Incidentally, the pixel array section 3 has a pixel circuit 9 disposed at each of intersections of signal lines DTL and writing control lines WSL.

An organic EL element is a current light emitting element. The organic EL panel therefore adopts a driving system that controls gradation by controlling an amount of current flowing through an organic EL element corresponding to each pixel. FIG. 2 shows one of simplest circuit configurations of pixel circuits 9 of this kind. This pixel circuit 9 includes a sampling transistor T1, a driving transistor T2, and a storage capacitor Cs.

The sampling transistor T1 is a thin film transistor for controlling the writing of a signal voltage Vsig corresponding to the gradation of the corresponding pixel to the storage capacitor Cs. The driving transistor T2 is a thin film transistor for supplying a driving current Ids to an organic EL element OLED on the basis of a gate-to-source voltage Vgs determined according to the signal voltage Vsig retained by the storage capacitor Cs. In the case of FIG. 2, the sampling transistor T1 is formed by an n-channel type thin film transistor, and the driving transistor T2 is formed by a p-channel type thin film transistor.

In the case of FIG. 2, the source electrode of the driving transistor T2 is connected to a power supply line to which a fixed potential (power supply potential Vcc) is applied, and the driving transistor T2 operates in a saturation region at all times. That is, the driving transistor T2 operates as a constant-current source supplying the organic EL element OLED with the driving current having a magnitude corresponding to the signal voltage Vsig. At this time, the driving current Ids is given by the following equation.

$$Ids=k\cdot\mu\cdot(Vgs-Vth)^2/2$$

where μ is the mobility of majority carriers of the driving transistor T2, Vth is the threshold voltage of the driving transistor T2, and k is a coefficient given by (W/L)·Cox, where W is channel width, L is channel Length, and Cox is a gate capacitance per unit area.

Incidentally, it is known that in the case of the pixel circuit of this configuration, the drain voltage of the driving transistor T2 is changed with temporal change in I-V characteristic of the organic EL element as shown in FIG. 3. However, because the gate-to-source voltage Vgs is held constant, an amount of current supplied to the organic EL element is unchanged, so that light emission luminance can be held constant.

The following are documents relating to organic EL panel displays adopting an active matrix driving system.

Japanese Patent Laid-open No. 2003-255856
Japanese Patent Laid-open No. 2003-271095
Japanese Patent Laid-open No. 2004-133240
Japanese Patent Laid-open No. 2004-029791
Japanese Patent Laid-open No. 2004-093682

SUMMARY OF THE INVENTION

The circuit configuration shown in FIG. 2 may not be able to be adopted depending on a kind of thin film process. That is, the present thin film process may not allow the adoption of the p-channel type thin film transistor. In such a case, the driving transistor T2 is replaced with an n-channel type thin film transistor.

FIG. 4 shows a configuration of a pixel circuit of this kind. In this case, the source electrode of a driving transistor T2 is connected to the anode terminal of an organic EL element OLED. However, in the case of this pixel circuit, gate-to-source voltage Vgs varies with temporal change in I-V characteristic of the organic EL element. This variation in gate-to-source voltage Vgs changes an amount of driving current, and changes light emission luminance.

In addition, the threshold value and mobility of the driving transistor T2 forming each pixel circuit differ in each pixel. The difference in threshold value and mobility of the driving transistor T2 appears as variations in driving current value, and thus light emission luminance is changed in each pixel.

Hence, in the case of adopting the pixel circuit shown in FIG. 4, there is a desire to establish a driving method by which a stable light emission characteristic is obtained irrespective of the temporal change. At the same time, realization of an EL display panel whose manufacturing cost is low is desired.

Accordingly, the inventor et al. propose an EL display panel including: a pixel array section in which EL display elements whose light emission state is controlled by an active matrix driving system are arranged in a form of a matrix; a first writing control line driving section and a second writing control line driving section configured to drive each writing control line from both sides of the pixel array section; and a first power supply line driving section and a second power supply line driving section configured to drive a power supply line disposed along a direction of a horizontal line from both sides of the pixel array section.

It is desirable with reason that the first power supply line driving section and the second power supply line driving section be respectively arranged between the first writing control line driving section and the pixel array section and between the second writing control line driving section and the pixel array section.

Incidentally, it is desirable that an output buffer circuit situated in a last output stage forming the first power supply line driving section and the second power supply line driving section be formed such that a direction of channel length of a thin film transistor is parallel with a signal line.

In addition, it is desirable that an output buffer circuit situated in a last output stage forming the first power supply line driving section and the second power supply line driving section be formed such that channel width of a thin film transistor is larger than length of one pixel in a direction of a signal line.

By adopting these arrangement structures, the size of the transistor forming the buffer circuit can be increased with respect to a pixel pitch. In addition, a wiring distance between the power supply line and a main electrode of the transistor can be shortened. Thus, the resistance value of the buffer circuit is decreased, so that bluntness of a waveform of power supply line potential and resistance can be reduced.

Incidentally, it is desirable that the writing control line and the power supply line within the pixel array section be low-resistance wiring. For example, it is desirable that the low-resistance wiring be aluminum, copper, gold, or an alloy of these metals. By adopting the low-resistance wiring, bluntness of a waveform of power supply line potential and resistance can be reduced.

The inventor et al. also propose an electronic device including an EL display panel of the above-described configuration.

The electronic device includes an EL display panel of the above-described configuration, a system control section configured to control operation of an entire system, and an operation input section configured to receive an operation input to the system control section.

According to an embodiment of the invention proposed by the inventor et al., the power supply line for supplying current to the EL light emitting element in each pixel region can be driven simultaneously by the power supply line driving sections arranged on both sides of the pixel array section. Thereby, even when the size of the pixel array section is increased and a time for driving the power supply line is shortened, it is possible to reduce bluntness of the waveform of the writing control line, and suppress the occurrence of shading effectively.

Further, by arranging the pair of power supply line driving sections closer to the pixel array section than the writing control line driving sections, the wiring length of the power supply line extending from output terminals of the power supply line driving sections can be made shorter than in a case where the power supply line driving sections are arranged on the outside of the writing control line driving sections.

In addition, by arranging the power supply line driving sections on the inside of the writing control line driving sections, the number of times that the power supply line three-dimensionally crosses wiring of the other driving sections can be reduced. Normally, wiring having a relatively high resistance value is used as wiring at intersecting parts because of a process. Decreasing three-dimensional intersecting parts is therefore effective in reducing a load on the power supply line driving sections.

It is thereby possible to decrease a voltage drop in the power supply line at a time of white display. This means a reduction in difference between voltage drops at a time of white display and at a time of black display. Hence, uniform image quality free from not only crosstalk but also shading can be obtained.

BRIEF DESCRIPTION OF THE DRAWINGS

FIGS. 31A, 31B, 31C, 31D, and 31E are diagrams representing an example of driving operation of the pixel circuit;

DETAILED DESCRIPTION OF THE PREFERRED EMBODIMENTS

Description will hereinafter be made of a case where the invention is applied to an organic EL panel of an active matrix driving type.

Incidentally, well known or publicly known techniques in a pertinent technical field are applied to parts not specifically shown in the figures or described in the present specification. In addition, embodiments to be described below are each an embodiment of the invention, and the invention is not limited to these embodiments.

(A) External Configuration

Incidentally, in the present specification, not only display panels in which a pixel array section and a driving circuit are formed on a same substrate using a same semiconductor process but also display panels in which a driving circuit manufactured as an application-specific IC, for example, is mounted on a substrate having a pixel array section formed thereon will be referred to as an organic EL panel.

Figure 1:
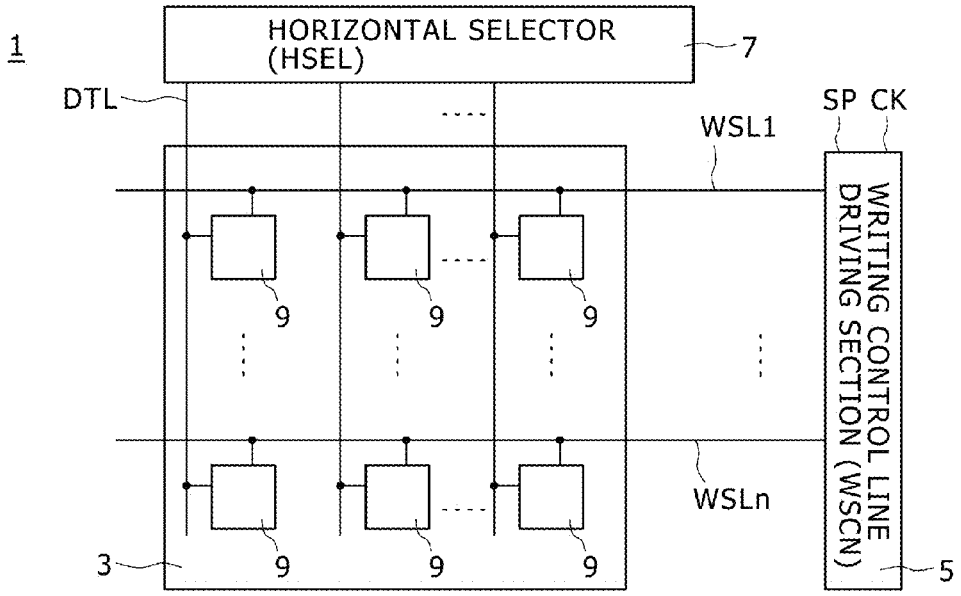
FIG. 1 is a diagram of assistance in explaining a block configuration of an organic EL panel.
Figure 2:
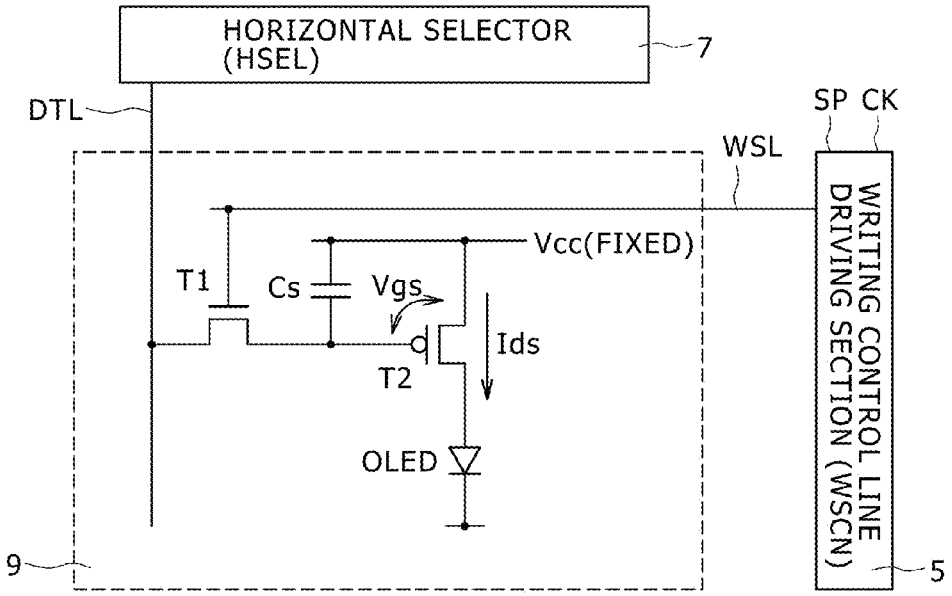
FIG. 2 is a diagram of assistance in explaining a connection relation between a pixel circuit and driving circuits.
Figure 3:
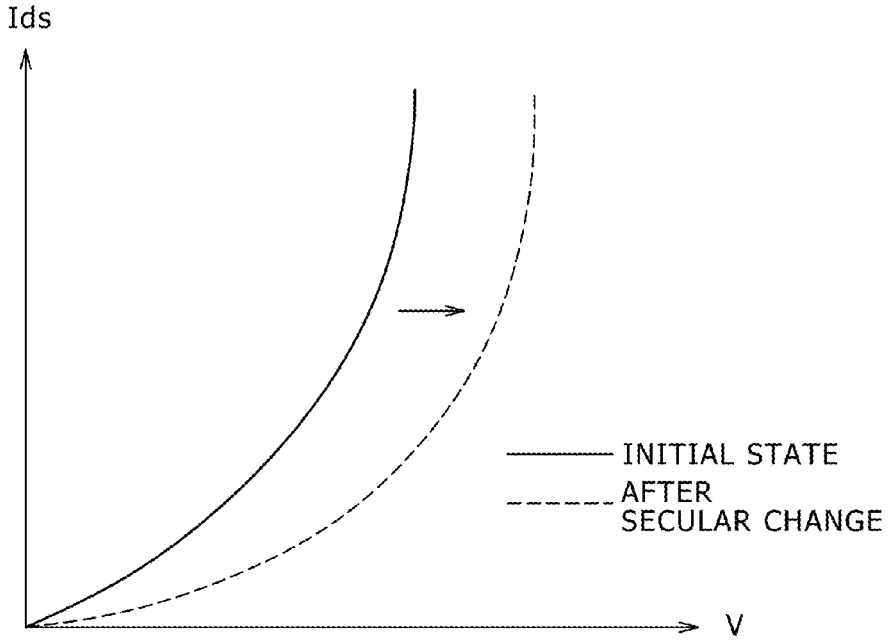
FIG. 3 is a diagram of assistance in explaining a temporal change in I-V characteristic of an organic EL element.
Figure 4:
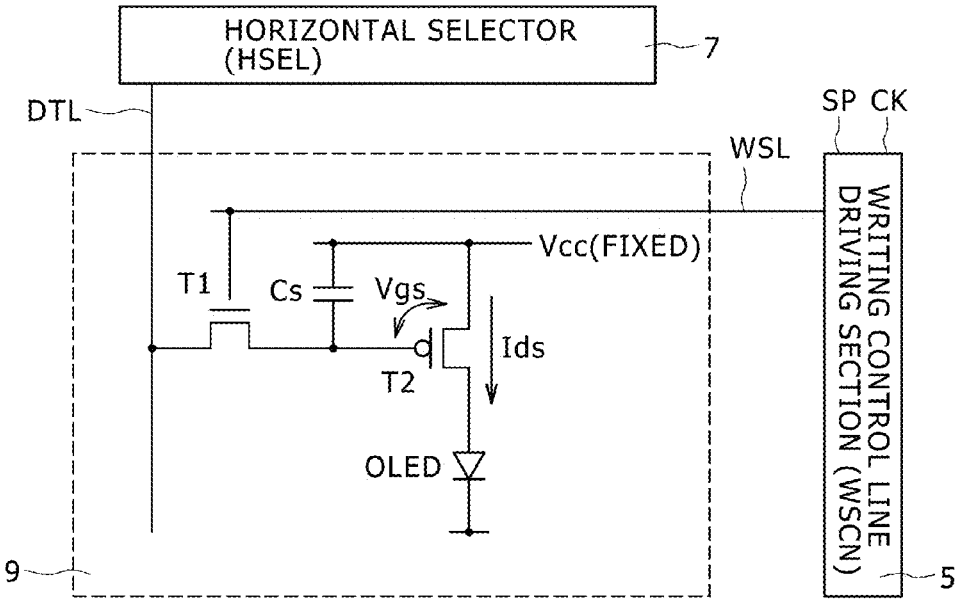
FIG. 4 is a diagram showing another example of a pixel circuit.
Figure 5:
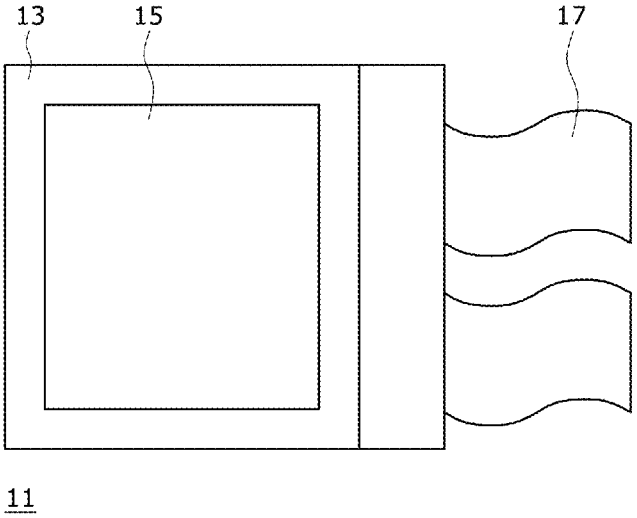
FIG. 5 is a diagram showing an example of external configuration of an organic EL panel.

FIG. 5 shows an example of external configuration of an organic EL panel. The organic EL panel 11 has a structure in which a counter part 15 is laminated to a pixel array section forming region of a supporting substrate 13.

The counter part 15 has a structure in which glass, plastic film, or another transparent member is used as a base material, and an organic EL layer, a protective film and the like are laminated to the surface of the base material.

Incidentally, the organic EL panel 11 has a FPC (flexible printed circuit) 17 for externally inputting or outputting a signal and the like to the supporting substrate 13.

(B) First Embodiment

(B-1) System Configuration

An example of system configuration of the organic EL panel 11 that prevents variations in characteristics of a driving transistor T2 and requires only a small number of elements forming a pixel circuit will be shown in the following. Incidentally, the present embodiment assumes an organic EL panel having a large screen size.

Figure 6:
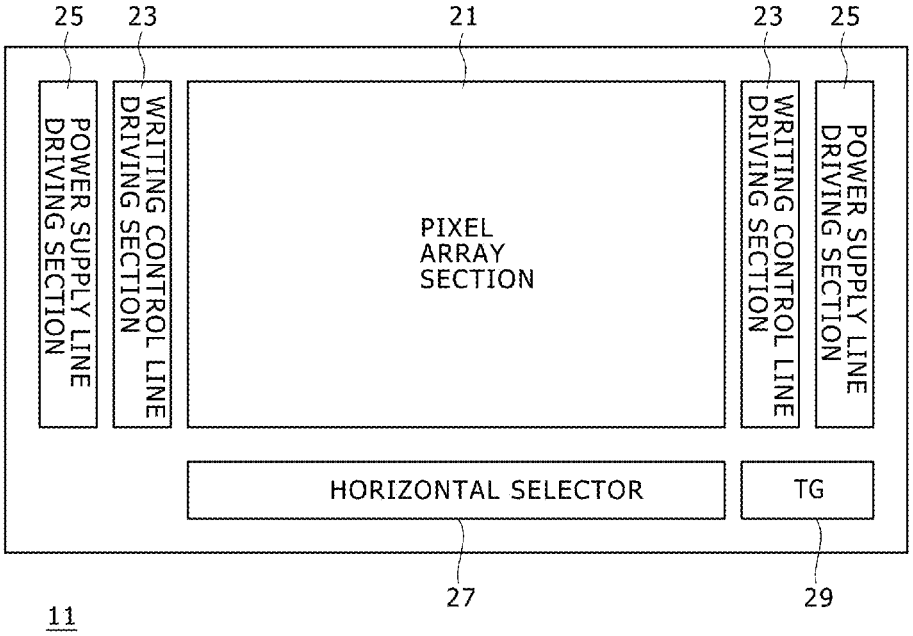
FIG. 6 is a diagram showing an example of system configuration of the organic EL panel.

FIG. 6 shows an example of system configuration of the organic EL panel 11. The organic EL panel 11 shown in FIG. 6 includes a pixel array section 21, writing control line driving sections 23 and power supply line driving sections 25 as driving circuits for the pixel array section 21, a horizontal selector 27, and a timing generator 29.

The pixel array section 21 has a matrix structure in which a sub-pixel is disposed at each intersecting position of a signal line DTL and a writing control line WSL. Incidentally, a sub-pixel is a minimum unit of a pixel structure forming one pixel. For example, one pixel as a white unit is formed by three sub-pixels (R, G, and B) of different organic EL materials.

Figure 7:
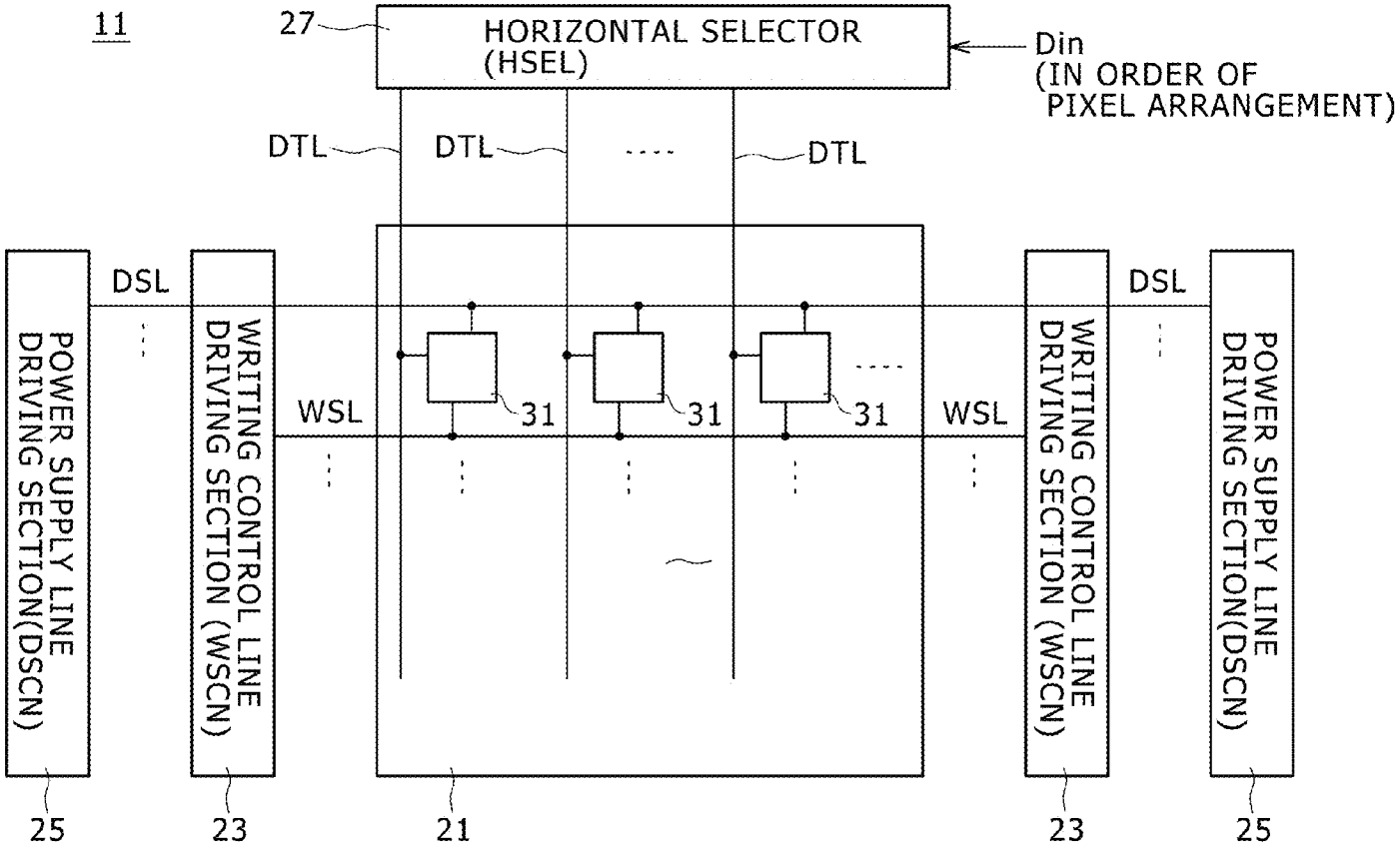
FIG. 7 is a diagram of assistance in explaining a connection relation between pixel circuits and driving circuits.
Figure 8:
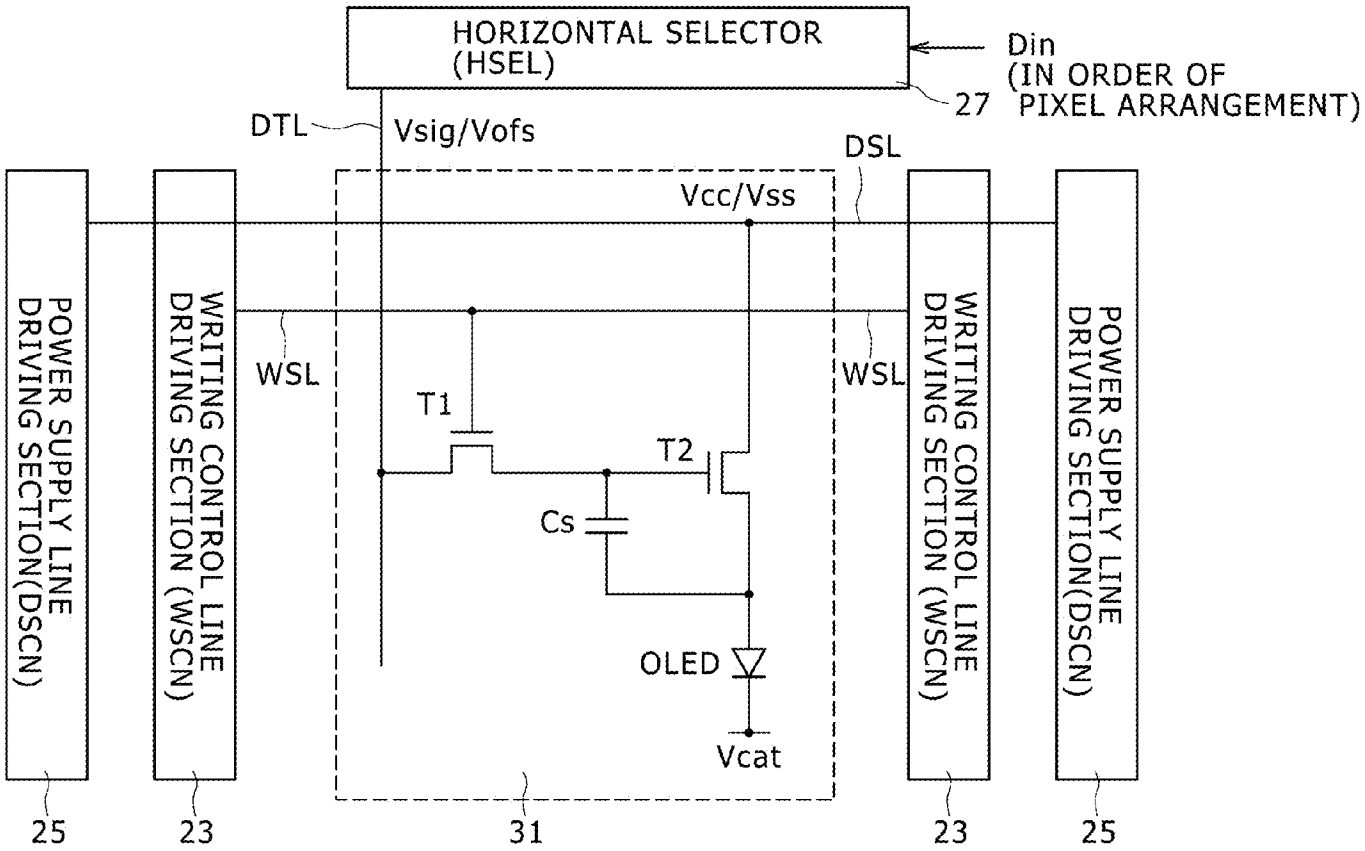
FIG. 8 is a diagram showing an example of configuration of a pixel circuit according to an embodiment.

FIG. 7 shows connection relation between pixel circuits 31 corresponding to sub-pixels and each driving circuit. FIG. 8 shows an internal configuration of a pixel circuit 31 proposed in the first embodiment. The pixel circuit shown in FIG. 8 includes two n-channel type thin film transistors T1 and T2 and one storage capacitor Cs.

Also in this circuit configuration, the writing control line driving sections 23 are used to perform opening and closing control on the sampling transistor T1 through a writing control line WSL and thereby control the writing of a signal line potential to the storage capacitor Cs. Incidentally, the writing control line driving sections 23 are formed by a shift register having a number of output stages which number is equal to the value of vertical resolution.

The present embodiment employs a system in which the two writing control line driving sections 23 operated by a same pulse are arranged on both sides of the pixel array section 21 to drive one writing control line WSL from both sides of the pixel array section 21 simultaneously.

Figures 9A, 9B:
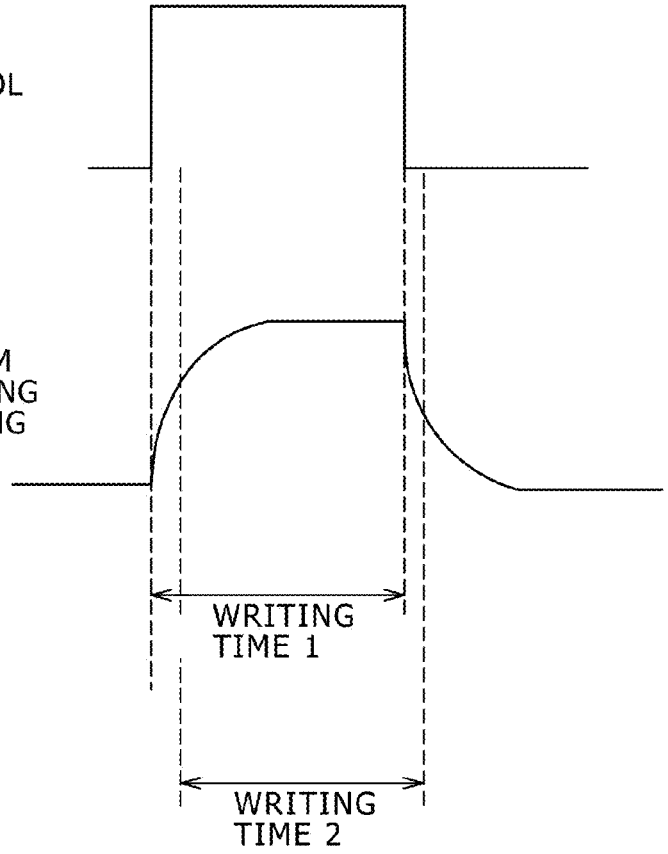
FIGS. 9A and 9B are diagrams of assistance in explaining a difference between potential changes occurring according to positional relation on a writing line.

When the organic EL panel 11 has a large screen size, as shown in FIGS. 9A and 9B, a change in potential of the writing control line WSL at a position distant from a writing control line driving section 23 (FIG. 9B) becomes blunt more easily than a change in potential of the writing control line WSL at a position near the writing control line driving section 23 (FIG. 9A). In addition, a writing time difference caused by the blunting of the waveform makes normal signal potential writing operation difficult, and causes shading.

On the other hand, when the two writing control line driving sections 23 are arranged on both sides of the pixel array section 21, a range driven by each individual writing control line driving section 23 is halved, and delay in and the blunting of changes in potential of the writing control line WSL can be minimized.

It is to be noted that, in the first embodiment, the writing control line driving sections 23 are disposed closer to the pixel array section 21 than the power supply line driving sections 25.

The power supply line driving sections 25 are used to control a power supply line DSL connected to one main electrode of the driving transistor T2 through a power supply line DSL on a binary basis and thereby control operation within the pixel circuit by an operation interlocked with the other driving circuits. The operation in this case includes not only emission and non-emission of an organic EL element but also an operation of correcting for characteristic variations. In the present embodiment, the correction for characteristic variations means correction for degradation in uniformity due to a variation in threshold value and a variation in mobility of the driving transistor T2.

In the present embodiment, the power supply line driving sections 25, the number of which is also two, are provided. The two power supply line driving sections 25 are arranged on both sides of the pixel array section 21 to drive one power supply line DSL from both sides of the pixel array section 21 simultaneously. This is because when the organic EL panel 11 has a large screen size, changes in potential of the power supply line DSL at a position distant from a power supply line driving section 25 tend to become blunt, thereby making normal timing control difficult.

On the other hand, when the two power supply line driving sections 25 are arranged on both sides of the pixel array section 21, a range driven by each individual power supply line driving section 25 is halved, and delay in and the blunting of changes in potential of the power supply line DSL can be minimized.

It is to be noted that, in the first embodiment, the power supply line driving sections 25 are disposed on the outside of the writing control line driving sections 23.

Figure 10:
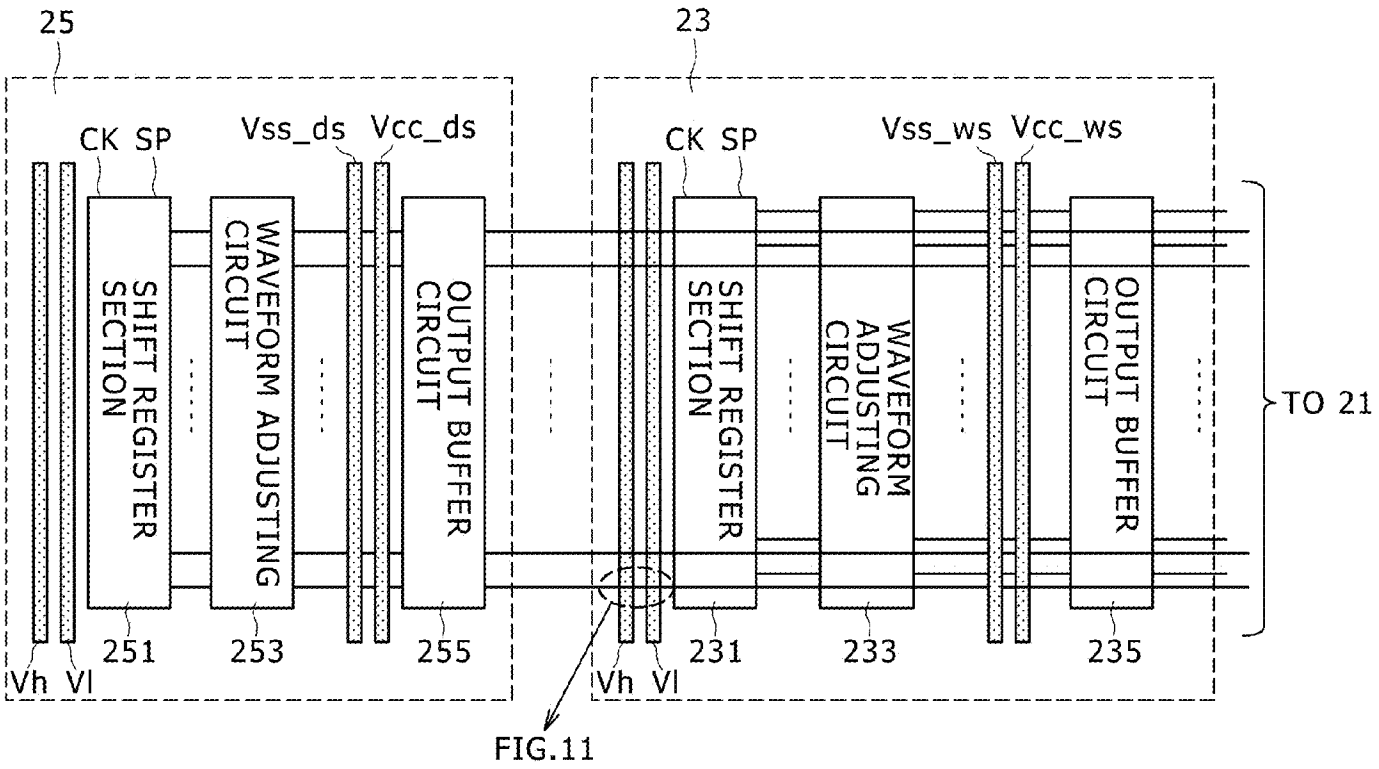
FIG. 10 is a diagram showing an example of internal configuration of a writing control line driving section and a power supply line driving section.

For reference, FIG. 10 shows an example of circuit configuration of a writing control line driving section 23 and a power supply line driving section 25. As shown in FIG. 10, the writing control line driving section 23 and the power supply line driving section 25 have a same basic configuration.

Specifically, the writing control line driving section 23 includes a shift register section 231, a waveform adjusting circuit 233, and an output buffer circuit 235. On the other hand, the power supply line driving section 25 includes a shift register section 251, a waveform adjusting circuit 253, and an output buffer circuit 255.

A shaded pattern shown in FIG. 10 is power supply wiring for driving each part. The power supply wiring indicated by "Vh" supplies a power supply potential of an "H-level" to the shift register sections 231 and 251 and the waveform adjusting circuits 233 and 253. On the other hand, the power supply wiring indicated by "V1" supplies a power supply potential of an "L-level" to the shift register sections 231 and 251 and the waveform adjusting circuits 233 and 253.

The power supply wiring indicated by "Vcc_* (* is ws or ds)" supplies a power supply potential of an "H-level" to the waveform adjusting circuits 233 and 253 and the output buffer circuits 235 and 255. On the other hand, the power supply wiring indicated by "Vss_* (* is ws or ds)" supplies a power supply potential of an "L-level" to the waveform adjusting circuits 233 and 253 and the output buffer circuits 235 and 255.

In this case, the shift register sections 231 and 251 are formed by flip-flop stages performing an operation of sequentially transferring a sampling pulse SP to a next stage according to a clock pulse CK. One of the flip-flop stages corresponds to one stage of a horizontal line.

The waveform adjusting circuits 233 and 253 adjust pulse width in a direction of a time axis and pulse height.

The output buffer circuits 235 and 255 are circuit devices that drive the writing control line WSL and the power supply line DSL, respectively, by respective corresponding binary power supply potentials. Specifically, the output buffer circuits 235 and 255 are formed by connecting one stage of an inverter circuit or more in series.

Incidentally, each of the pieces of power supply wiring is disposed so as to be perpendicular to the horizontal line. On the other hand, power supply lines DSL driven by the power supply line driving sections 25 are each arranged in parallel with the horizontal line.

Figure 11:
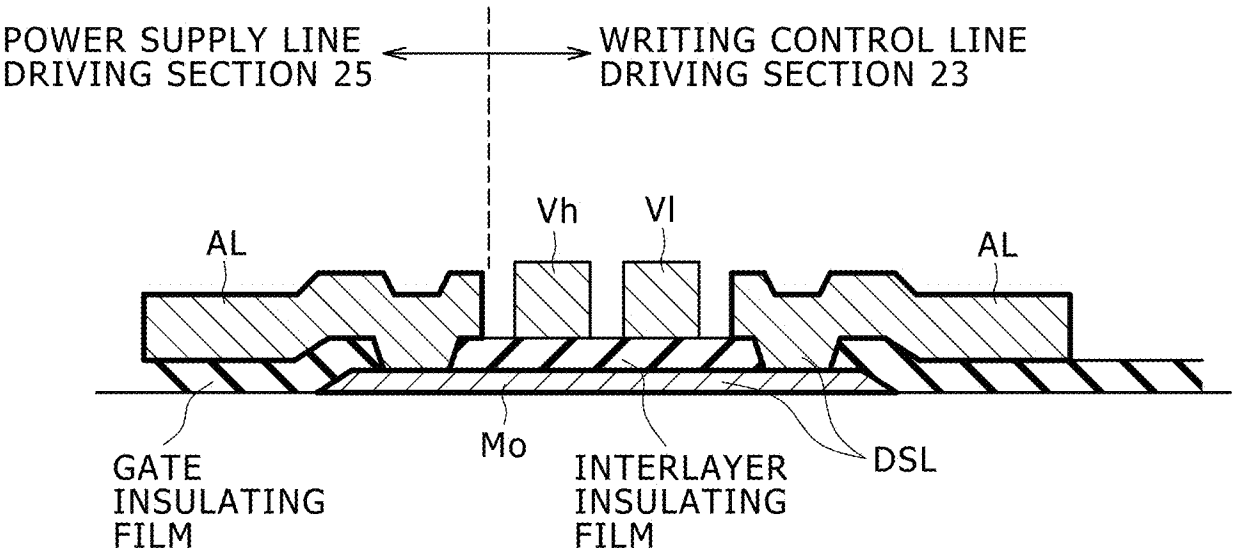
FIG. 11 is a diagram of assistance in explaining the sectional structure of a broken line region in FIG. 10.
Figures 12A, 12B, 12C, 12D, 12E:
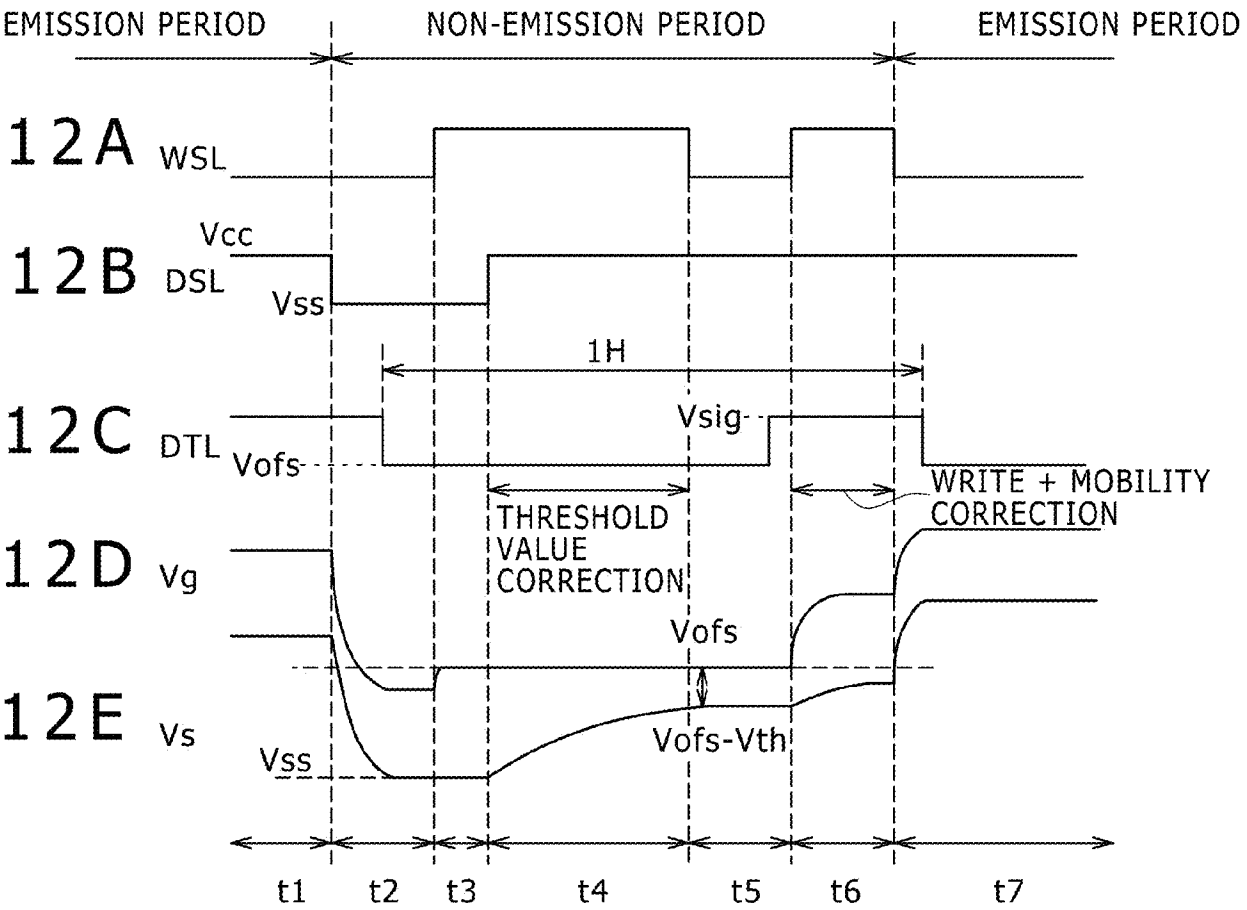
FIGS. 12A, 12B, 12C, 12D, and 12E are diagrams representing an example of driving operation according to the embodiment.

Thus, as shown in FIG. 11, the power supply line DSL has a wiring structure that crosses the power supply wiring within the writing control line driving section 23 three-dimensionally.

Wiring for power supply is basically formed of aluminum. However, aluminum requires a large film thickness. Thus, a metallic material such as molybdenum or the like that generally requires only a small film thickness is used at three-dimensional crossing parts.

Consequently, in the case of the organic EL panel 11 shown in FIG. 6, the power supply line DSL is formed as mixed wiring of aluminum and molybdenum.

Incidentally, in the case of the organic EL panel 11 having the structure shown in FIG. 6, a total of four three-dimensional crossings, two on each of the left and the right of the pixel array section 21, are formed for one power supply line DSL.

The horizontal selector 27 is used to apply a signal potential Vsig corresponding to pixel data Din or an offset voltage Vofs for threshold value correction to a signal line DTL. The horizontal selector 27 includes a shift register having a number of output stages which number is equal to the value of horizontal resolution, a latch circuit corresponding to each output stage, and a D/A converter circuit.

The timing generator 29 is a circuit device for generating a timing pulse necessary to drive the writing control line WSL, the power supply line DSL, and the signal line DTL.

(B-2) Example of Driving Operation

FIGS. 12A, 12B, 12C, 12D, and 12E represent an example of driving operation of the pixel circuit shown in FIG. 8. Incidentally, in FIGS. 12A to 12E, the higher potential (emission potential) of two power supply potentials applied to the power supply line DSL is denoted by Vcc, and the lower potential (non-emission potential) is denoted by Vss.

Figure 13:
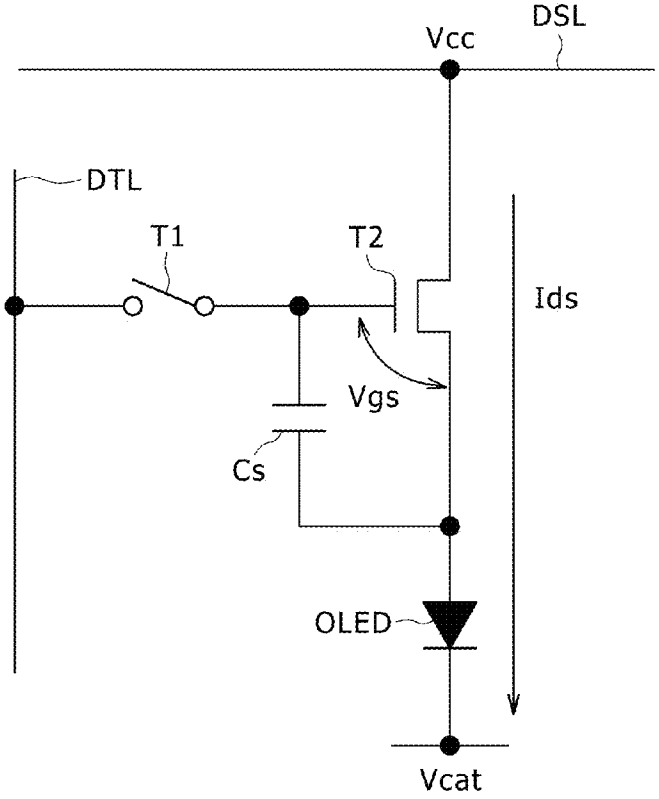
FIG. 13 is a diagram of assistance in explaining a state of operation of the pixel circuit.

First, conditions of operation within the pixel circuit in an emission state are shown in FIG. 13. At this time, the sampling transistor T1 is in an off state. Meanwhile, the driving transistor T2 operates in a saturation region, and a current Ids determined according to a gate-to-source voltage Vgs flows (FIGS. 12A to 12E (t1)).

Conditions of operation in a non-emission state will next be described. At this time, the potential of the power supply line DSL changes from the high potential Vcc to the low potential Vss (FIGS. 12A to 12E (t2)). At this time, when the low potential Vss is lower than a sum of a threshold value Vthel and a cathode potential Vcath of the organic EL element, that is, when Vss<Vthel+Vcath, the organic EL element is quenched.

Figure 14:
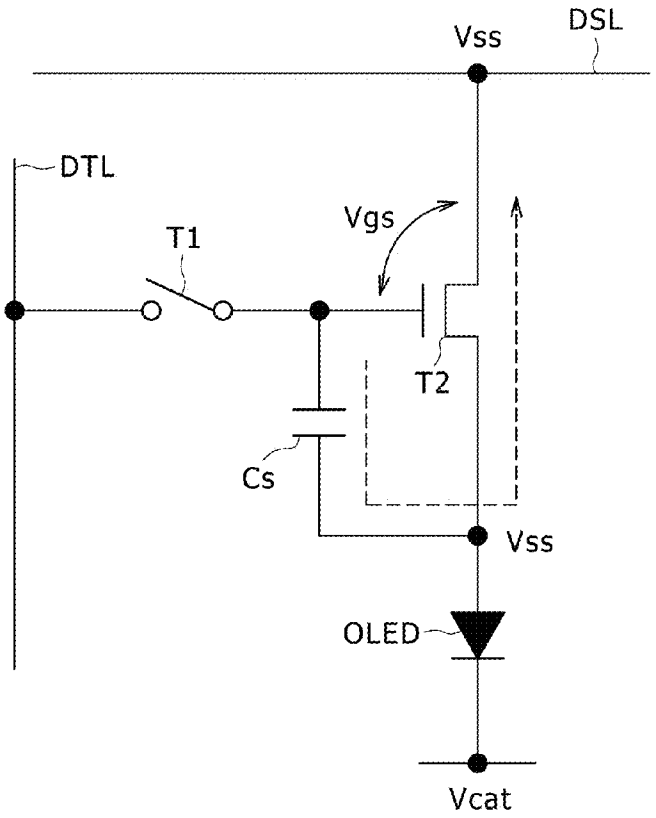
FIG. 14 is a diagram of assistance in explaining a state of operation of the pixel circuit.

Incidentally, the source potential Vs of the driving transistor T2 becomes equal to the potential of the power supply line DSL. That is, the anode electrode of the organic EL element is charged to the low potential Vss. FIG. 14 shows conditions of operation within the pixel circuit. As indicated by a broken line in FIG. 14, at this time, a charge retained by the storage capacitor Cs is taken out to the power supply line DSL.

Thereafter, when the writing control line WSL is changed to a high potential with the potential of the signal line DTL having made a transition to the offset potential Vofs for threshold value correction, the gate potential of the driving transistor T2 is changed to the offset potential Vofs through the sampling transistor T1 that has performed an on operation (FIGS. 12A to 12E (t3)).

Figure 15:
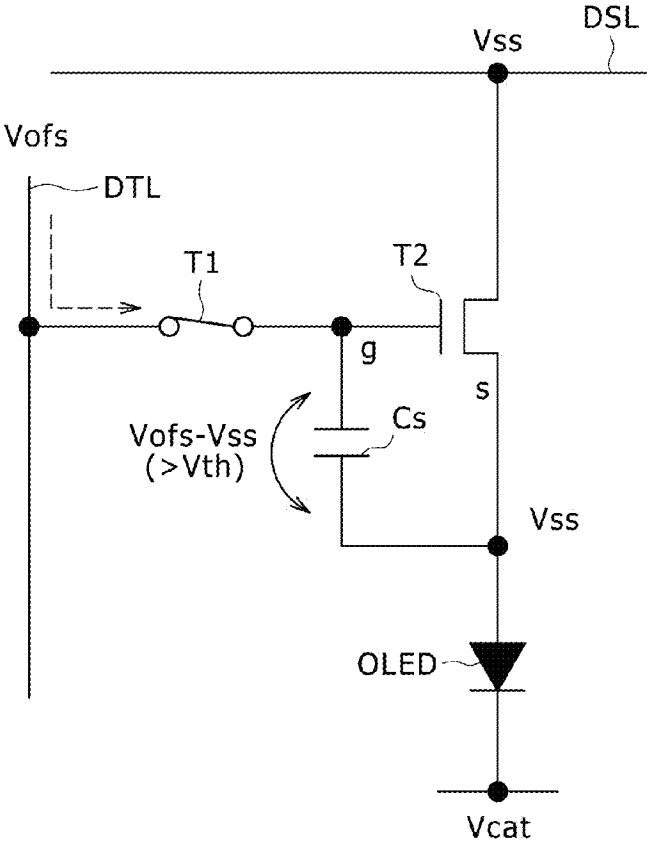
FIG. 15 is a diagram of assistance in explaining a state of operation of the pixel circuit.

FIG. 15 shows conditions of operation within the pixel circuit in this case. At this time, the gate-to-source voltage Vgs of the driving transistor T2 is given by Vofs−Vss. This voltage is set larger than the threshold voltage Vth of the driving transistor T2. This is because threshold value correcting operation cannot be performed unless Vofs−Vss>Vth is satisfied.

Next, the power supply potential of the power supply line DSL is changed to the high potential Vcc again (FIGS. 12A to 12E (t4)). Because the power supply potential of the power supply line DSL is changed to the high potential Vcc, the anode potential Vel of the organic EL element OLED becomes the source potential Vs of the driving transistor T2.

Figure 16:
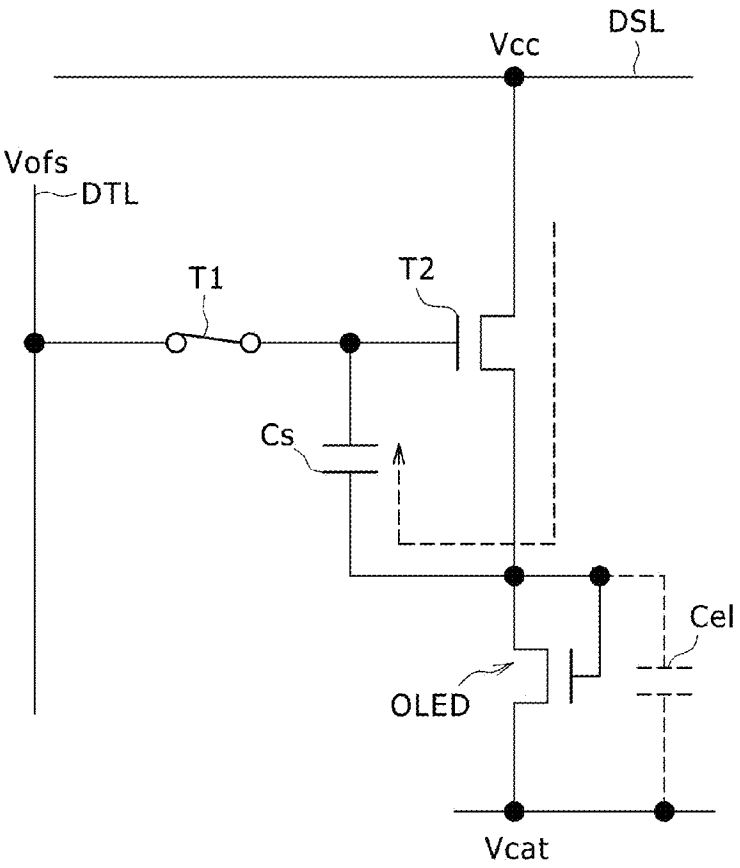
FIG. 16 is a diagram of assistance in explaining a state of operation of the pixel circuit.

FIG. 16 represents the organic EL element OLED by an equivalent circuit. That is, FIG. 16 shows the organic EL element OLED as a diode and a parasitic capacitance Cel. At this time, as long as a relation Vel≤Vcat+Vthel is satisfied (however, the leakage current of the organic EL element is considered to be considerably smaller than the driving current Ids flowing through the driving transistor T2), the driving current Ids flowing through the driving transistor T2 is used to charge the storage capacitor Cs and the parasitic capacitance Cel.

Figure 17:
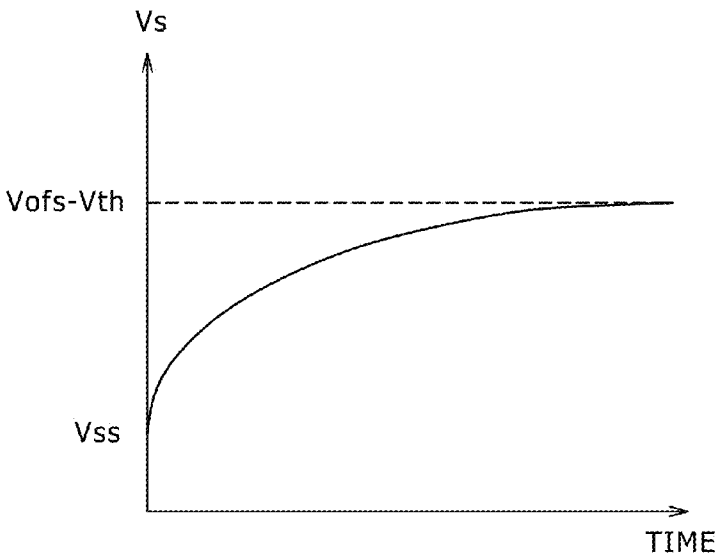
FIG. 17 is a diagram showing change in source potential with the passage of time.

Consequently, as shown in FIG. 17, the anode potential Vel of the organic EL element OLED rises with the passage of time. That is, the source potential Vs of the driving transistor T2 starts rising with the gate potential of the driving transistor T2 fixed at the offset potential Vofs. This operation is the threshold value correcting operation.

The gate-to-source voltage Vgs of the driving transistor T2 eventually converges to the threshold voltage Vth. At this time, Vel=Vofs−Vth≤Vcat+Vthel is satisfied.

When the threshold value correcting period is ended, the sampling transistor T1 is controlled to be off again (FIGS. 12A to 12E (t5)).

Figure 18:
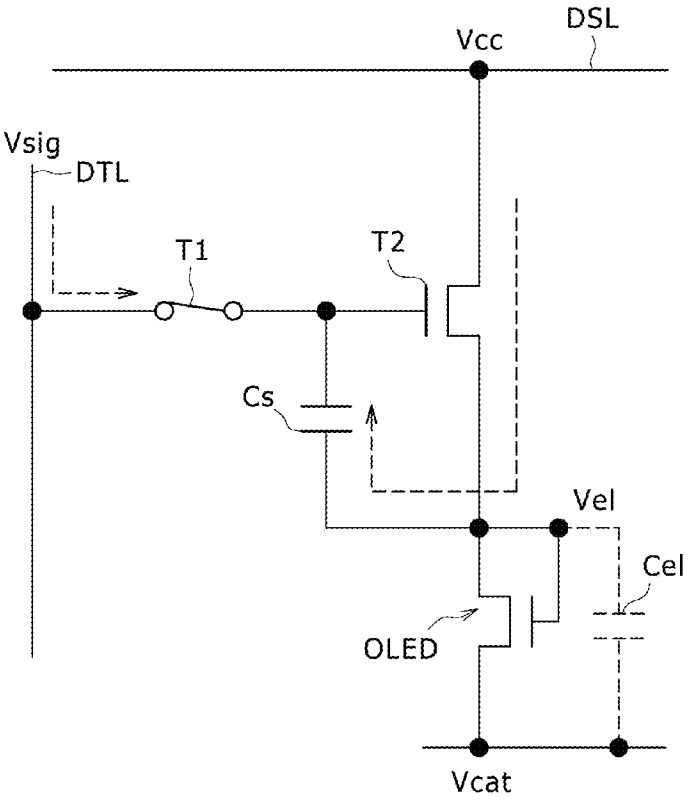
FIG. 18 is a diagram of assistance in explaining a state of operation of the pixel circuit.

Thereafter, the sampling transistor T1 is controlled to be in an on state again after timing necessary for the potential of the signal line DTL to make a transition to a signal potential Vsig (FIGS. 12A to 12E (t6)). FIG. 18 shows conditions of operation within the pixel circuit in this case. The signal potential Vsig is given according to the gradation value of the corresponding pixel.

At this time, the gate potential Vg of the driving transistor T2 makes a transition to the signal potential Vsig. Meanwhile, the source potential Vs of the driving transistor T2 is raised with time by a current flowing from the power supply line DSL to the storage capacitor Cs.

At this time, unless the source potential Vs of the driving transistor T2 exceeds a sum of the threshold voltage Vthel and the cathode voltage Vcat of the organic EL element (the leakage current of the organic EL element is considered to be considerably smaller than the current flowing through the driving transistor T2), the driving current Ids supplied by the driving transistor T2 is used to charge the storage capacitor Cs and the parasitic capacitance Cel.

Figure 19:
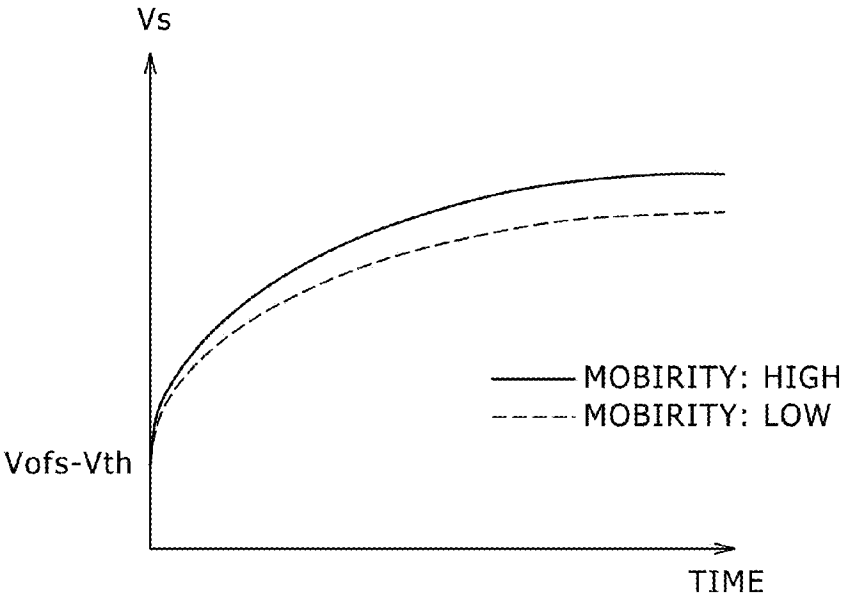
FIG. 19 is a diagram showing a difference between changes with the passage of time which difference is due to difference in mobility.

Incidentally, because the threshold value correcting operation of the driving transistor T2 is already completed, the driving current Ids fed by the driving transistor T2 has a value reflecting the mobility μ of the driving transistor T2. Specifically, the higher the mobility μ of the driving transistor, the larger the driving current Ids flowing through the driving transistor, and the more rapidly the source potential Vs rises. Conversely, the lower the mobility μ of the driving transistor, the smaller the driving current Ids flowing through the driving transistor, and the more slowly the source potential Vs rises (FIG. 19).

Consequently, the voltage retained by the storage capacitor Cs is corrected according to the mobility μ of the driving transistor T2. That is, the gate-to-source voltage Vgs of the driving transistor T2 is changed to a voltage corrected for the mobility μ.

Figure 20:
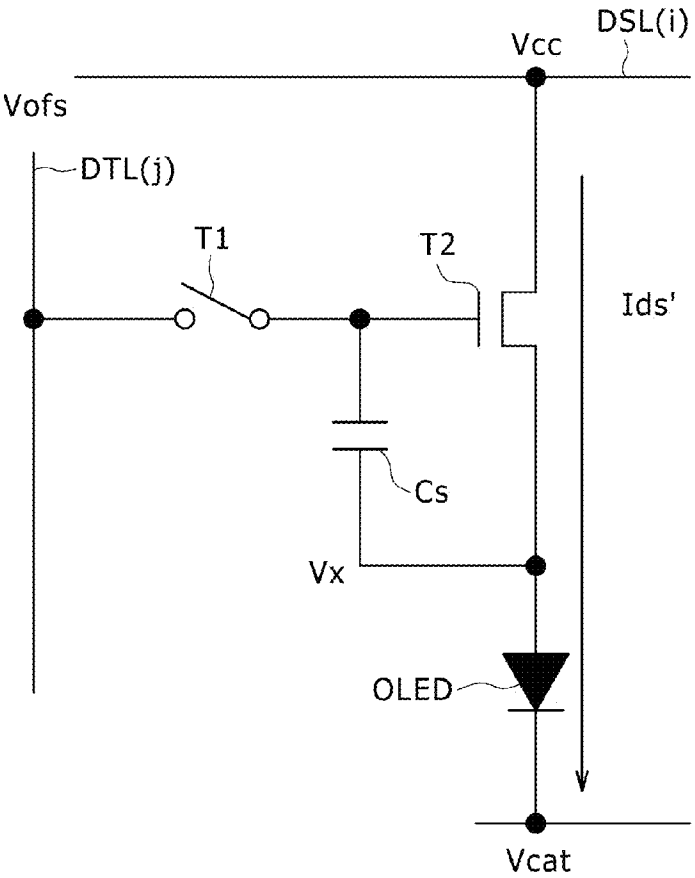
FIG. 20 is a diagram of assistance in explaining a state of operation of the pixel circuit.

Finally, when the sampling transistor T1 is controlled to be turned off and thereby the writing of the signal potential is ended, the emission period of the organic EL element OLED begins (FIGS. 12A to 12E (t7)). FIG. 20 shows conditions of operation within the pixel circuit in this case. Incidentally, the gate-to-source voltage Vgs of the driving transistor T2 is constant. Thus, the driving transistor T2 supplies a constant current Ids' to the organic EL element.

With this, the anode potential Vel of the organic EL element rises to a potential Vx at which the current Ids' is passed through the organic EL element. The light emission of the organic EL element is thereby started.

Also in the case of the driving circuit proposed in the present embodiment, the I-V characteristic of the organic EL element OLED changes as the emission period becomes longer.

That is, the source potential Vs of the driving transistor T2 also changes. However, because the gate-to-source voltage Vgs of the driving transistor T2 is held constant by the storage capacitor Cs, the amount of the current flowing through the organic EL element OLED does not change. Thus, when the pixel circuit and the driving system proposed in the present embodiment are adopted, the driving current Ids corresponding to the signal potential Vsig can be made to continuously flow at all times irrespective of changes in the I-V characteristic of the organic EL element OLED. It is thereby possible to maintain the light emission luminance of the organic EL element OLED at a luminance corresponding to the signal potential Vsig.

(B-3) Summary

As described above, by adopting the pixel circuit and the driving system described in the present embodiment, an organic EL panel without luminance variation in each pixel can be realized even when the driving transistor T2 is formed by an n-channel type thin film transistor.

In addition, in the present embodiment, the writing control line driving sections 23 and the power supply line driving sections 25 are disposed on both sides of the pixel array section 21, so that each writing control line WSL and each power supply line DSL can be driven and controlled from both sides simultaneously.

Thus, even when the pixel array section 21 is increased in size, and a time for driving the power supply line DSL is shortened, it is possible to reduce bluntness of the waveform of the writing control line WSL, and suppress the occurrence of shading effectively.

In addition, while a difference in voltage between both ends of the screen is inevitably large when the power supply line DSL is driven from one side of the screen, the difference in voltage on the power supply line DSL can be decreased by driving the power supply line DSL from both sides of the screen. In particular, because the organic EL element is a current-driven element, the difference in voltage on the power supply line DSL leads directly to difference in driving current (light emission luminance). Thus, by decreasing the voltage difference, it is possible to reduce the effect of a voltage drop (that is, crosstalk) at a time of white display.

As described above, by adopting the present embodiment, it is possible to realize an organic EL panel that can provide a stable light emission characteristic irrespective of secular changes though using only re-channel type thin film transistors, and at the same time makes degradation in display quality within the screen difficult to perceive.

(C) Second Embodiment (C-1) System Configuration

Description will be made below of a panel structure that can further improve display quality of an organic EL panel having a large screen size.

Figure 21:
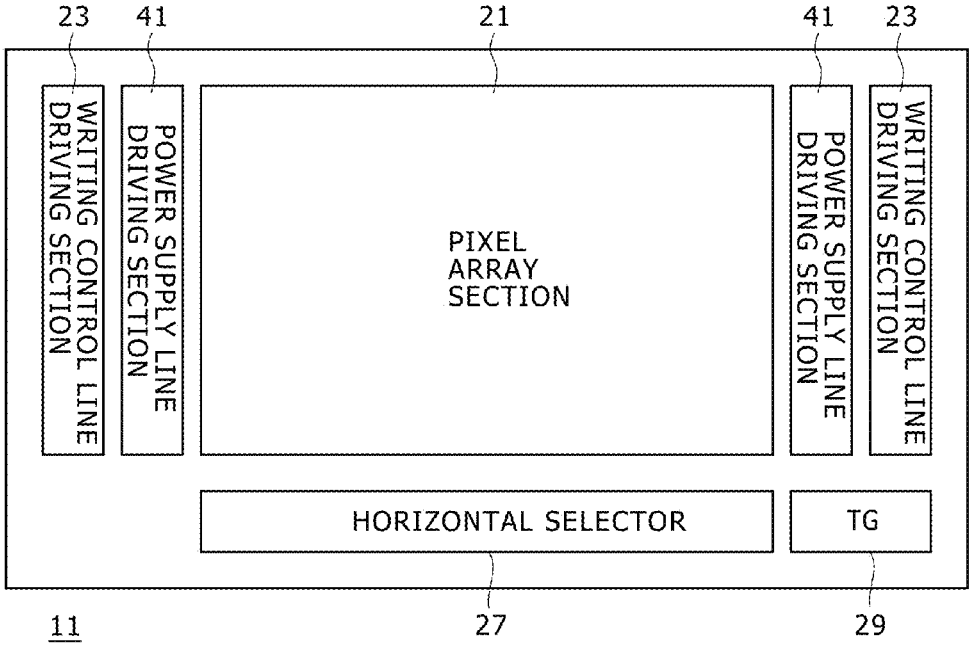
FIG. 21 is a diagram showing another example of configuration of an organic EL panel according to another embodiment.

FIG. 21 shows an example of system configuration of an organic EL panel 11. Incidentally, in FIG. 21, parts corresponding to those of FIG. 6 are identified by the same reference numerals. As shown in FIG. 21, a basic system configuration is the same. Specifically, the organic EL panel 11 shown in FIG. 21 also includes a pixel array section 21, writing control line driving sections 23 and power supply line driving sections 41 as driving circuits for the pixel array section 21, a horizontal selector 27, and a timing generator 29.

A difference lies in positional relation within the panel between the writing control line driving sections 23 and the power supply line driving sections 41.

First, in the present embodiment, the positional relation between the writing control line driving sections 23 and the power supply line driving sections 41 is changed. Specifically, the power supply line driving sections 41 are disposed closer to the pixel array section than the writing control line driving sections 23.

In addition, in the present embodiment, an output buffer circuit forming the power supply line driving sections 41 is increased in size, and the resistance value of a buffer part is reduced.

Figure 22:
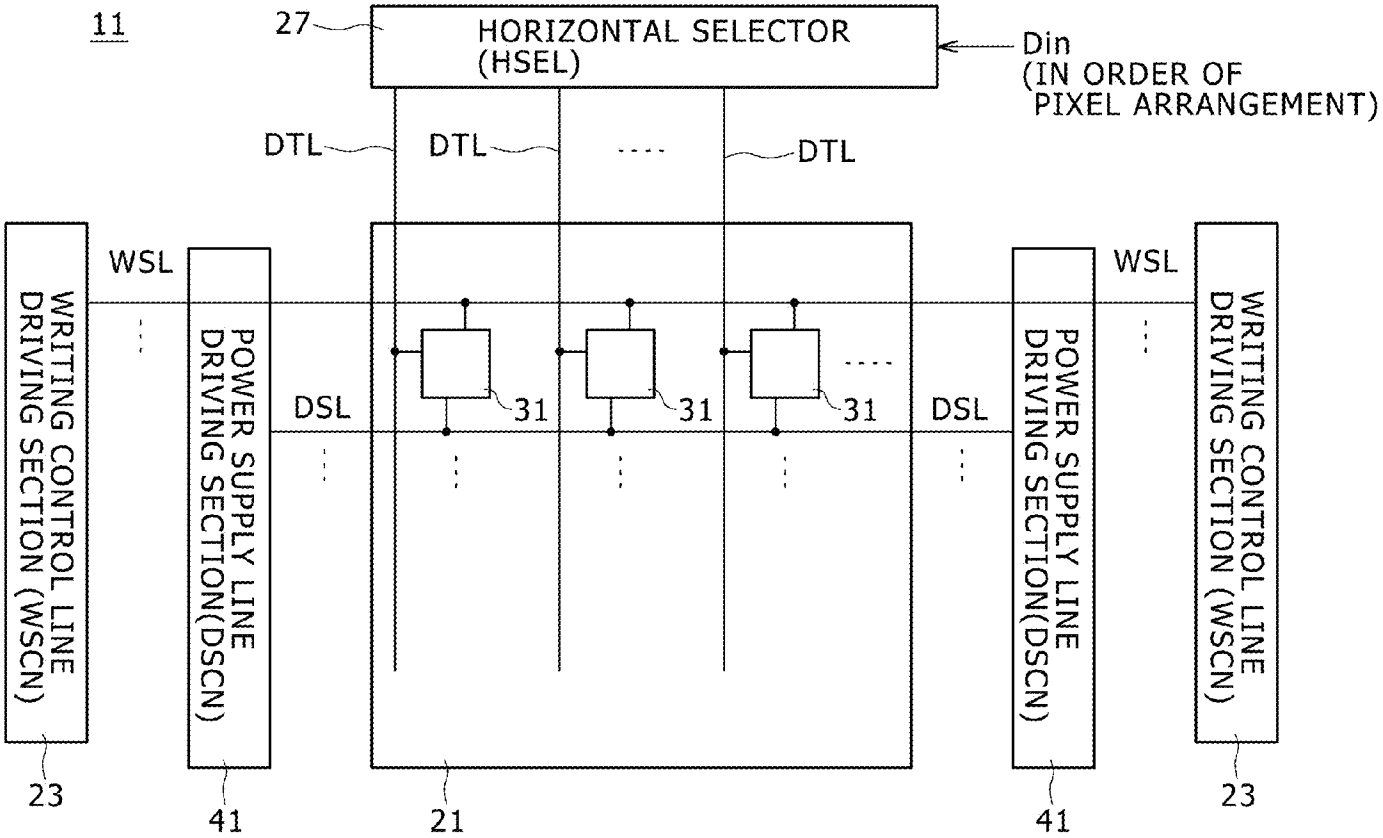
FIG. 22 is a diagram of assistance in explaining a connection relation between pixel circuits and driving circuits.
Figure 23:
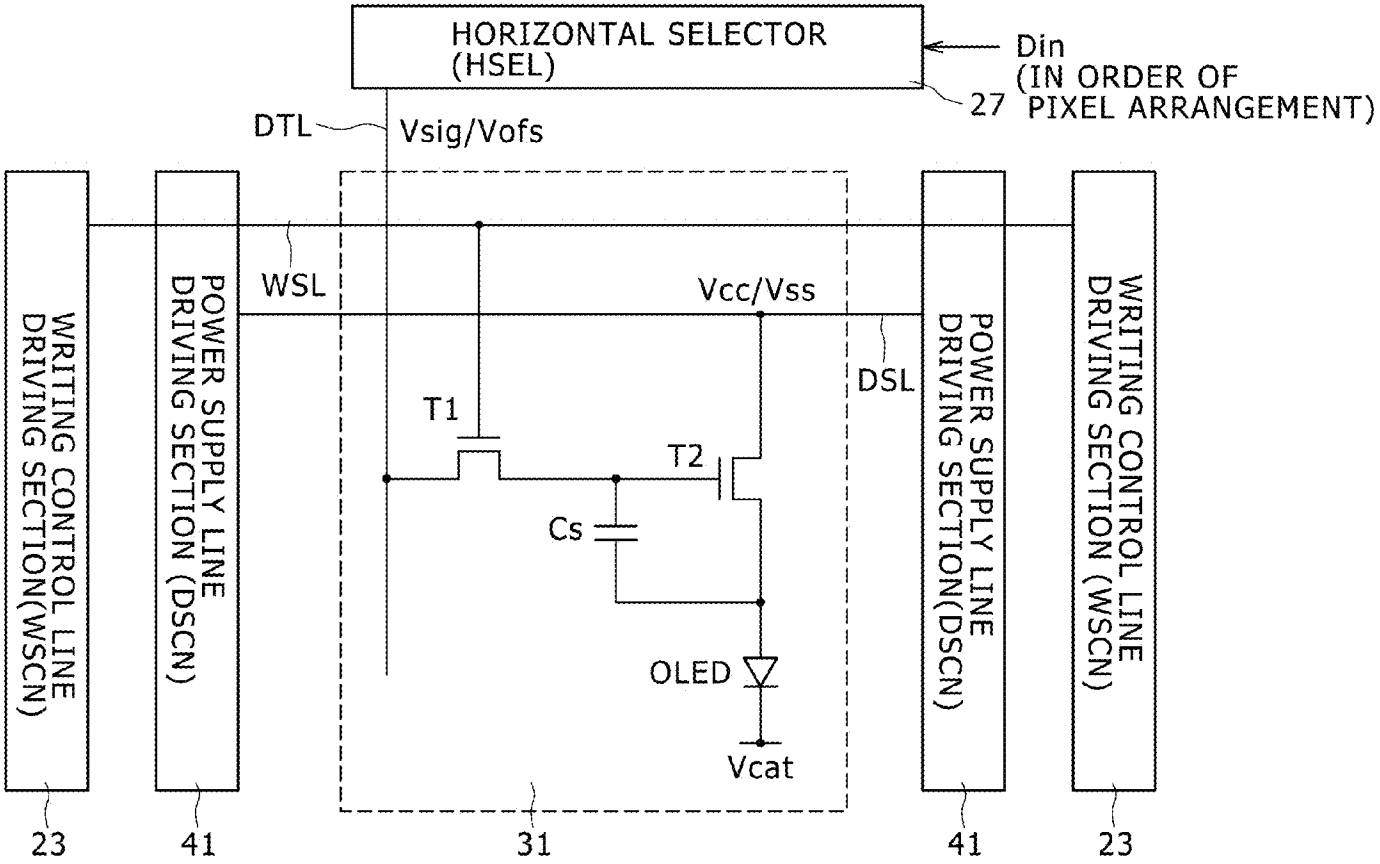
FIG. 23 is a diagram showing an example of configuration of a pixel circuit according to the embodiment.

FIG. 22 shows a connection relation between pixel circuits 31 corresponding to sub-pixels and each driving circuit. In addition, FIG. 23 shows an internal configuration of a pixel circuit 31.

Figure 24:
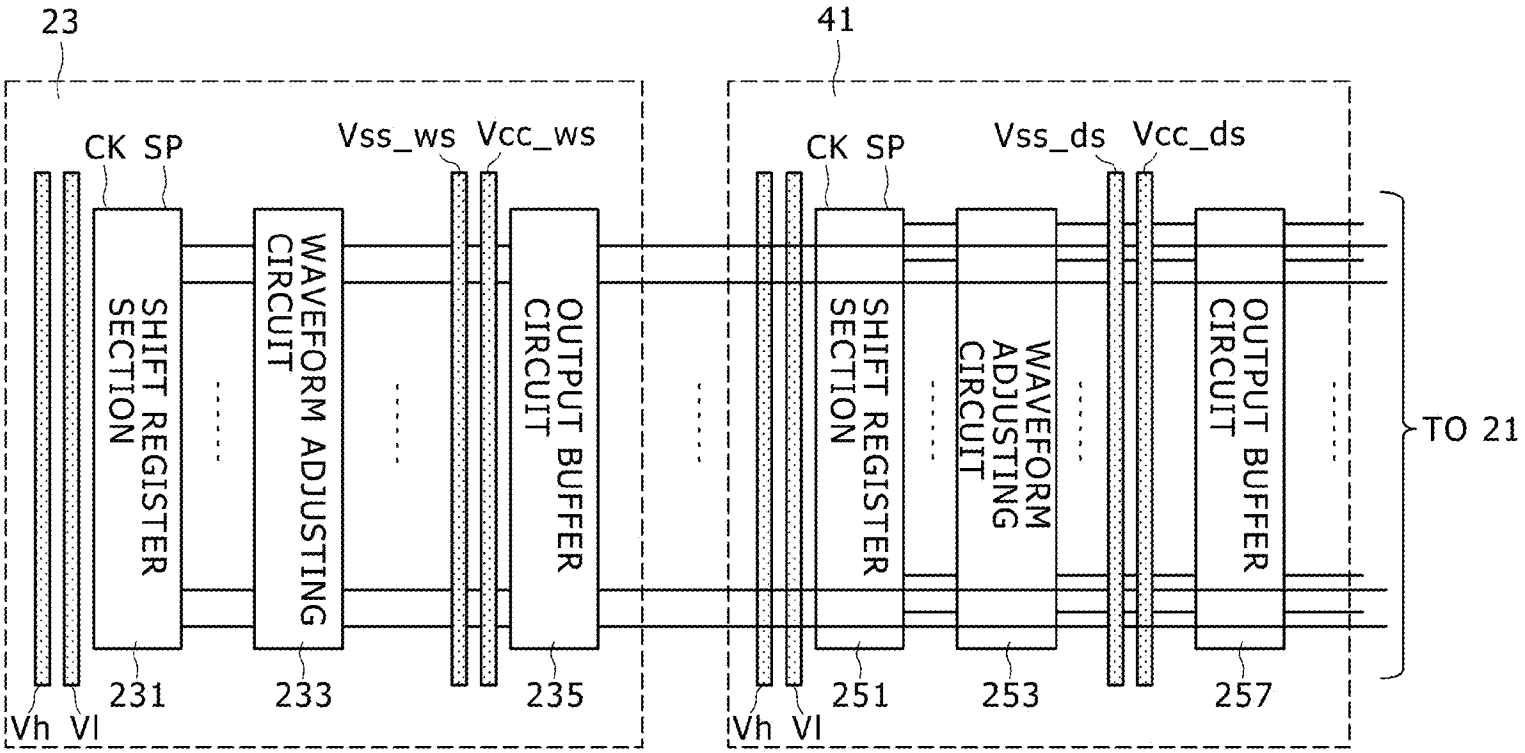
FIG. 24 is a diagram showing an example of internal configuration of a writing control line driving section and a power supply line driving section.

Further, FIG. 24 shows wiring relation between a writing control line driving section 23 and a power supply line driving section 41. As shown in FIG. 24, this time, writing control lines WSL driven and controlled by the writing control line driving section 23 are mixed wiring, and the writing control lines WSL three-dimensionally cross at power supply wiring for supplying driving power to the power supply line driving section 41.

On the other hand, because the number of times that power supply lines DSL three-dimensionally cross power supply wiring for supplying driving power is smaller than in the first embodiment, the power supply lines DSL can be formed by a low-resistance metal alone. In the present embodiment, the power supply lines DSL are formed by aluminum.

Furthermore, because the positional relation of the driving sections is changed, the wiring length of the power supply lines DSL is shorter than in the first embodiment. Thus, the wiring resistance of the power supply lines DSL is lower than in the first embodiment. The panel structure proposed in the present embodiment can therefore reduce the possibility of crosstalk or shading being visually recognized as compared with the first embodiment.

On the other hand, the resistance value of the writing control lines WSL in the second embodiment is higher than in the first embodiment. Consequently, a maximum value of a writing time difference on a horizontal line is increased as compared with the first embodiment.

However, shading caused by the writing time difference is not visually recognized unless luminance difference becomes about 20%. Therefore the problem of the writing time difference can be suppressed by both-side driving even when the writing control line driving sections 23 are disposed on the outside of the power supply line driving sections 41.

On the other hand, crosstalk caused by a voltage drop in the power supply line DSL is visually recognized even when the luminance difference is about 1%. Thus, being able to decrease the wiring resistance of the power supply line DSL as in the second embodiment has great technical effect.

The driving transistor T2 within each pixel circuit operates in a saturation region. Thus, even when the wiring resistance is low, Early effect still exists.

Figure 25:
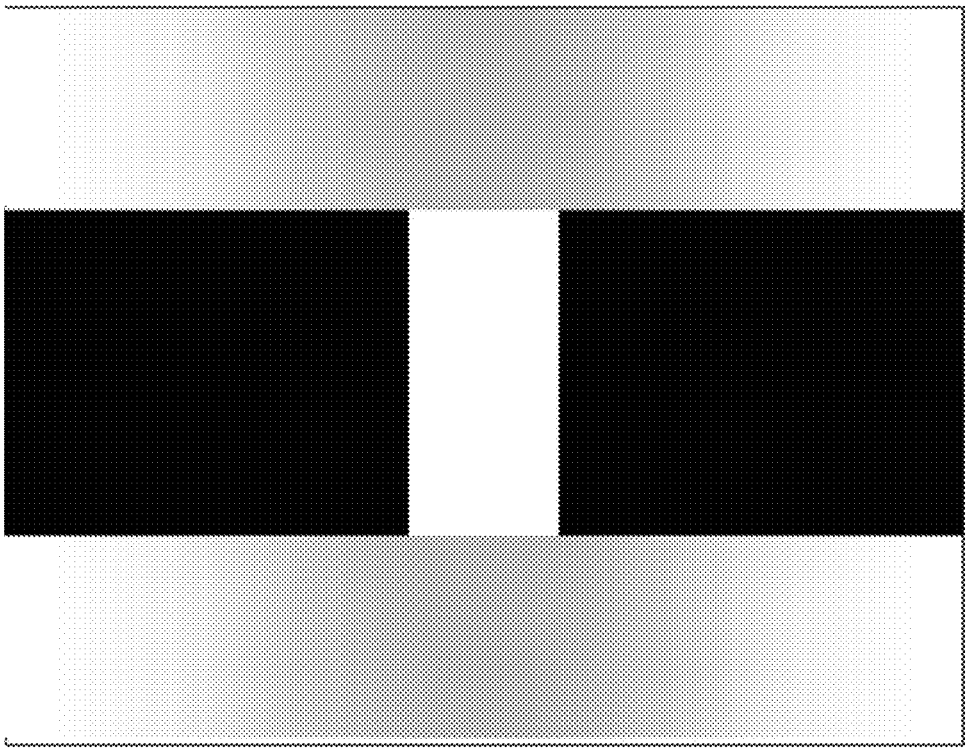
FIG. 25 is a diagram showing an example of a displayed image.

Thus, when a kind of image as shown in FIG. 25 is input to the organic EL panel 11, a potential difference occurs between a voltage drop of a power supply line of a white display line and a voltage drop of a power supply line of a black window display line.

A crosstalk is visually recognized when the potential difference becomes equal to or more than 1% of the luminance difference.

The occurrence of crosstalk depends on a difference between the amounts of power supply voltage drops of display lines (horizontal lines). That is, not only the part of the power supply lines DSL but also the output resistance value of an output buffer circuit 257 has great effect on the occurrence of crosstalk.

Figure 26:
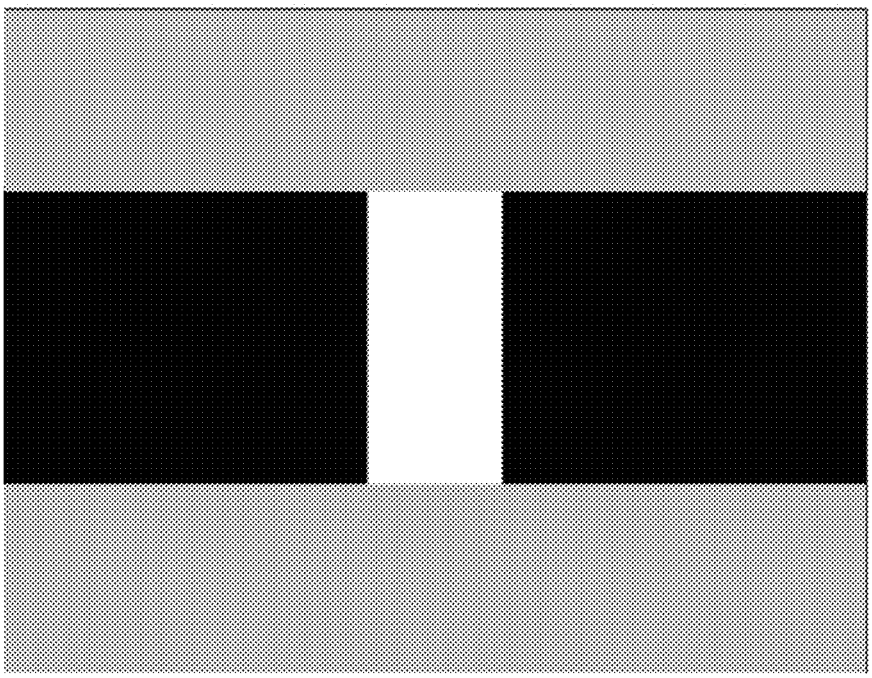
FIG. 26 is a diagram showing an example of a displayed image.

For example, when the output buffer circuit 257 has a high output resistance value even though the wiring resistance of the power supply lines DSL is low, the luminance of a white display line at a time of displaying black windows as shown in FIG. 26 is lowered by the voltage drop, which is visually recognized as a crosstalk.

Accordingly, the power supply line driving sections 41 in which the output resistance value of the output buffer circuit 257 is reduced are proposed in the present embodiment.

Figure 27:
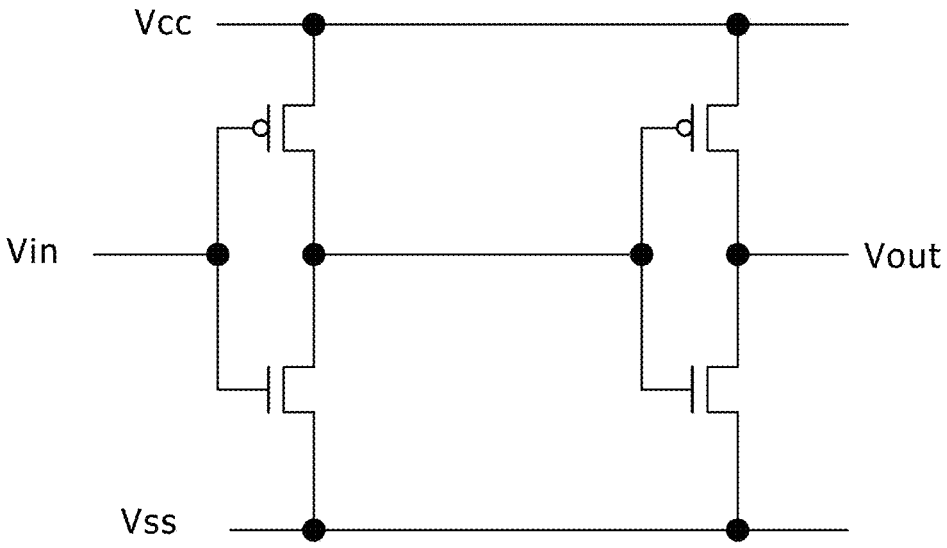
FIG. 27 is a diagram showing an example of circuit configuration of an output buffer circuit.

As an example, FIG. 27 shows an equivalent circuit of the output buffer circuit 257 forming the power supply line driving section 41. Suppose that as shown in FIG. 27, the output buffer circuit 257 is formed by a two-stage connection of CMOS inverter circuits.

Figure 28:
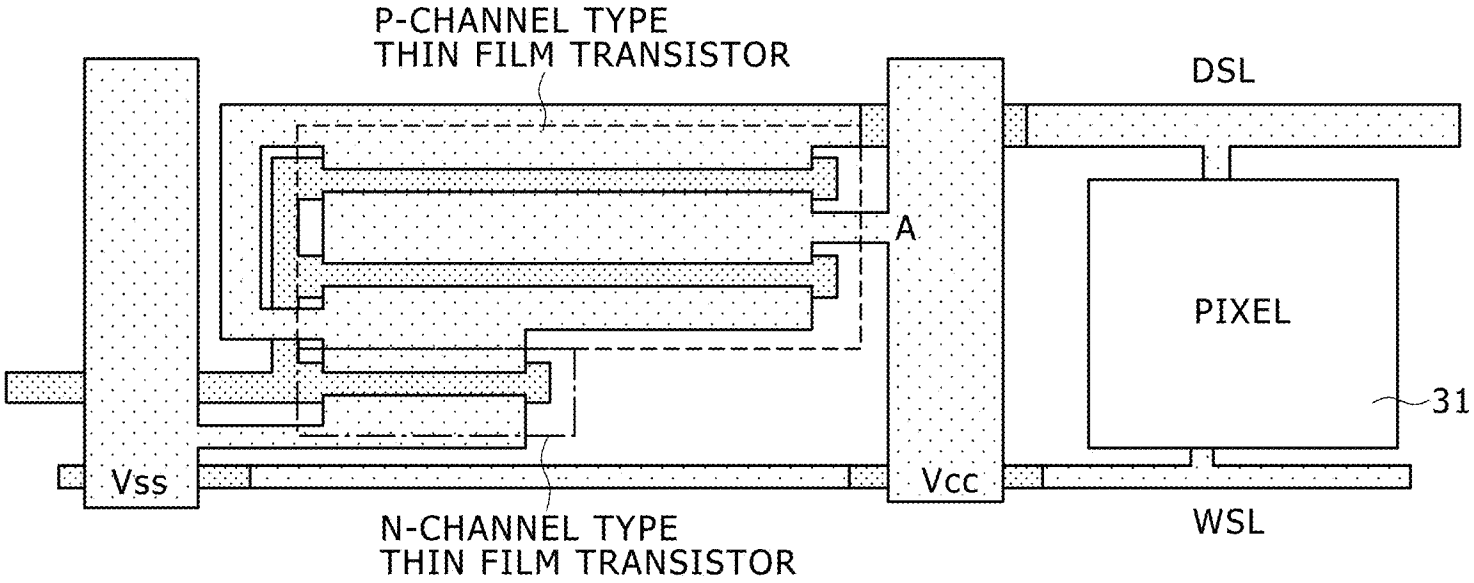
FIG. 28 is a diagram showing an example of a horizontal type layout pattern adopted in an inverter circuit forming a last stage of the output buffer circuit.

FIG. 28 shows a plane structure of a CMOS inverter circuit forming a last stage of the output buffer circuit 257.

Regions enclosed by broken lines in FIG. 28 respectively correspond to a p-channel type thin film transistor and an n-channel type thin film transistor. As shown in FIG. 28, the size of the p-channel type thin film transistor is larger than the size of the n-channel type thin film transistor. Specifically, the size of the p-channel type thin film transistor is 1.5 times or more and preferably about 10 times larger than the size of the n-channel type thin film transistor. This is to reduce wiring resistance from power supply wiring Vcc.

However, increase of the size of the p-channel type thin film transistor is actually limited by a pixel pitch. In addition, the pixel pitch is decreased with increase in resolution. A device is therefore necessary to increase the size of the p-channel type thin film transistor in a limited layout.

In general, to reduce the output resistance of the output buffer circuit 257, the channel width of the p-channel type thin film transistor needs to be increased.

Accordingly, the CMOS inverter circuit in the last stage is formed as a horizontal type as shown in FIG. 28. That is, the CMOS inverter circuit in the last stage is formed such that the direction of channel length of the p-channel type thin film transistor is parallel with a signal line (orthogonal to the direction of a horizontal line). At this time, preferably, the p-channel type thin film transistor is formed such that channel width of the p-channel type thin film transistor is larger than length of one pixel in the direction of the signal line. The adoption of this structure enables a large amount of current to flow and enables output resistance to be correspondingly reduced.

Figure 29:
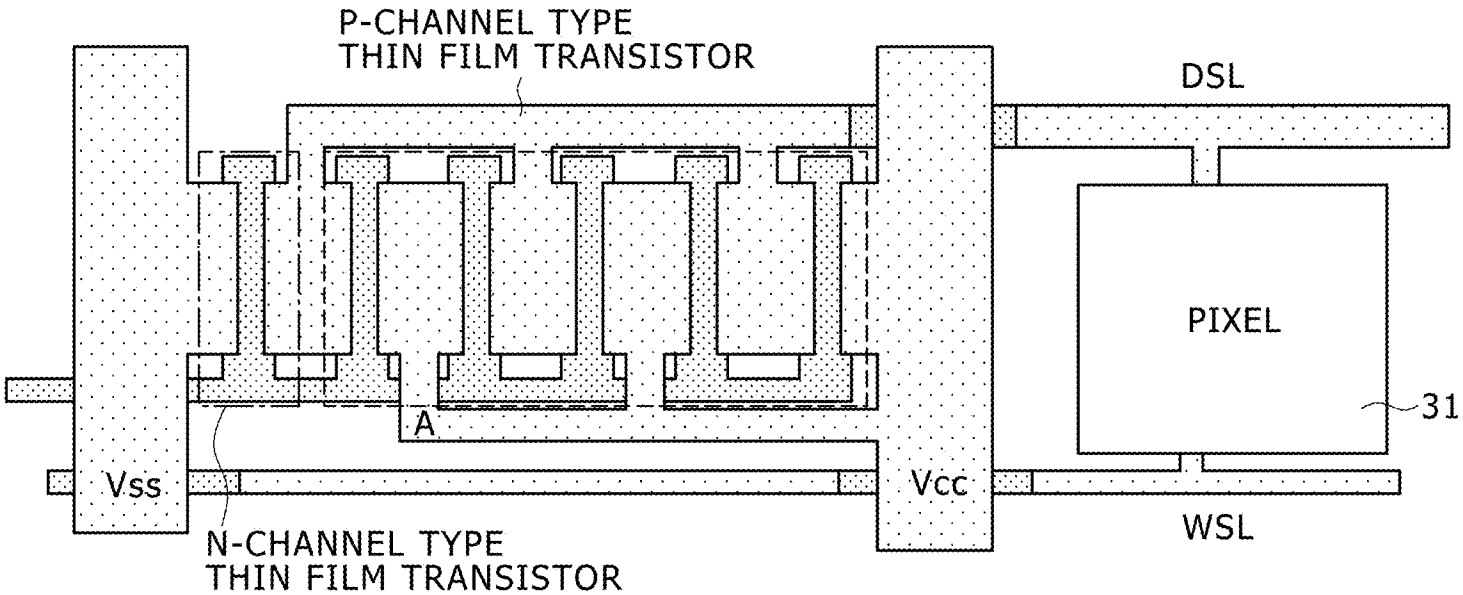
FIG. 29 is a diagram showing an example of a vertical type layout pattern adopted in an inverter circuit forming a last stage of the output buffer circuit.

In addition, this horizontal type of layout has another advantage of a shorter distance between a channel and power supply wiring Vcc than in a layout of a vertical type as shown in FIG. 29. The distance in this case is given by a length from the power supply wiring Vcc to point A shown in FIG. 28 and FIG. 29.

Clearly, the length between the power supply wiring Vcc and the channel can be made shorter in the horizontal type of layout.

(C-2) Summary

As described above, in the present embodiment, by forming the power supply line driving sections 41 closer to the pixel array section 21 than the writing control line driving sections 23, it is possible to shorten the wiring length of the power supply lines DSL and simplify the wiring structure (reduce three-dimensional crossings), and reduce the wiring resistance.

In addition, by forming the inverter circuit forming the last stage of the output buffer circuit 257 in the power supply line driving section 41 such that the direction of the channel of the p-channel type thin film transistor of the inverter circuit is parallel with the signal line DTL (adopting the horizontal layout), wiring resistance within the output buffer circuit 257 can be reduced.

Consequently, the overall wiring resistance of the power supply lines DSL including the output stage of the output buffer circuit 257 can be reduced. It is thus possible to realize the organic EL panel 11 that makes a difference between power supply voltage drops on power supply lines DSL smaller than in the first embodiment even when Early effect is considered, and thus makes crosstalk more difficult to recognize visually.

That is, the organic EL panel 11 from which high image quality is expected in principle can be realized.

In addition, the direction of the channel of the output buffer circuit 257 is parallel with the direction of the signal line. Thus, a narrower frame of the organic EL panel 11 can also be achieved.

(D) Other Embodiments (D-1) Wiring Materials for Power Supply Lines DSL

In the case of the second embodiment described above, the power supply lines DSL are formed of aluminum.

However, aluminum, copper, gold, and alloys thereof may be used for the power supply lines DSL in the second embodiment. The wiring resistance values of these wiring materials can each be made lower than that of molybdenum. Thus, these materials are advantageous for lowering the resistance of the power supply lines DSL.

(D-2) Other Examples of Pixel Circuit

In the foregoing embodiments, the pixel circuit 31 includes two thin film transistors. Therefore a driving system is adopted in which a reference voltage for threshold value correction (hereinafter referred to as an offset voltage) Vofs is applied through the signal line DTL.

However, a transistor dedicated to controlling timing of application of the offset voltage Vofs may be disposed.

Figure 30:
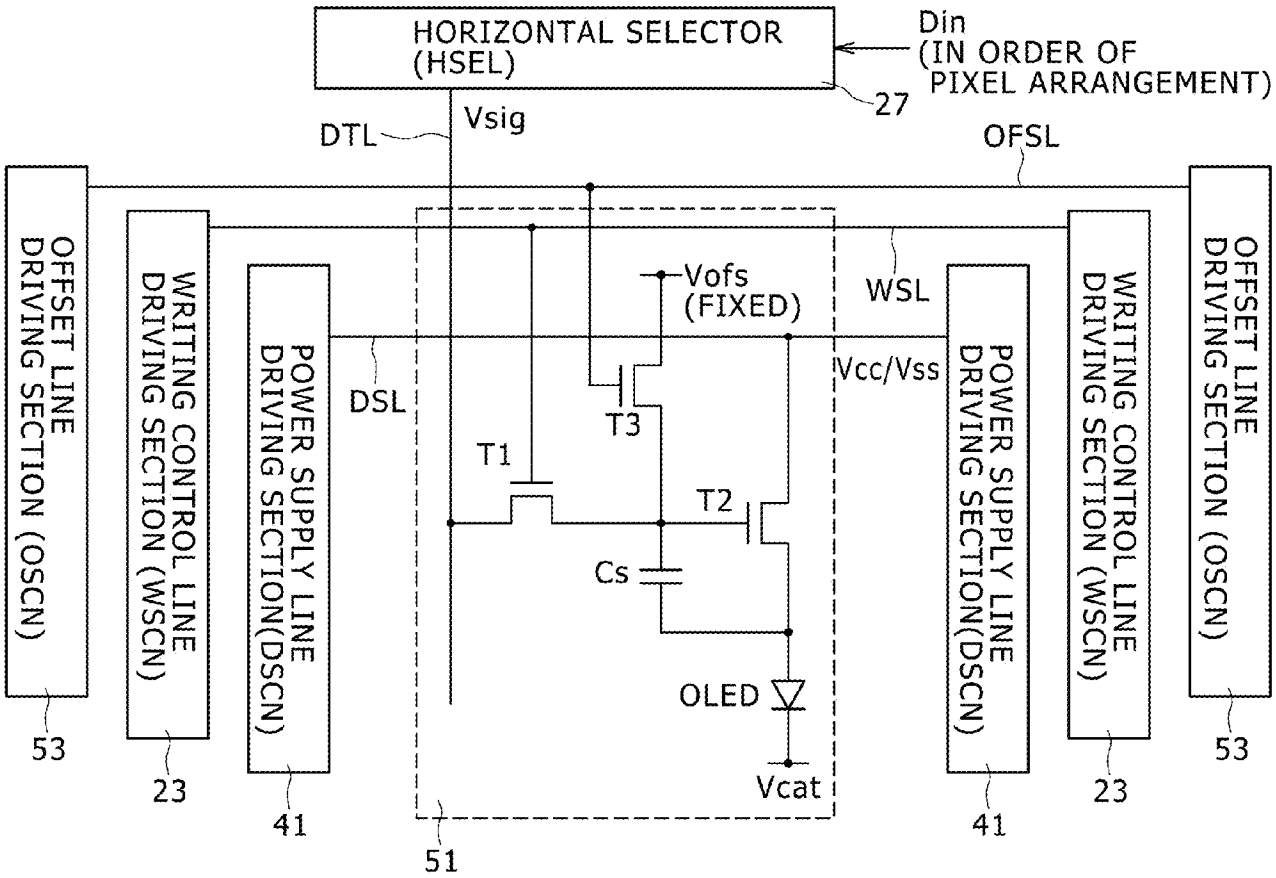
FIG. 30 is a diagram of assistance in explaining another connection relation between a pixel circuit and driving circuits.

FIG. 30 shows an example of configuration of a pixel circuit 51 corresponding to an example of modification. The pixel circuit 51 has a second sampling transistor T3 disposed therein. One of main electrodes of the second sampling transistor T3 is connected to the gate electrode of a driving transistor T2. The other main electrode is connected to an offset line OFSL that supplies a fixed offset voltage Vofs.

Incidentally, the second sampling transistor T3 is controlled to be turned on and off by offset line driving sections 53.

In the present example, only a signal potential Vsig corresponding to each pixel is applied to a signal line DTL. Incidentally, the offset line driving sections 53 and writing control line driving sections 23 shown in FIG. 30 may be interchanged in positional relation to each other.

FIGS. 31A, 31B, 31C, 31D, and 31E represent an example of driving operation of the pixel circuit described with reference to FIG. 30. Incidentally, in FIGS. 31A to 31E, the higher potential (emission potential) of two power supply potentials applied to a power supply line DSL is denoted by Vcc, and the lower potential (non-emission potential) is denoted by Vss.

Figure 32:
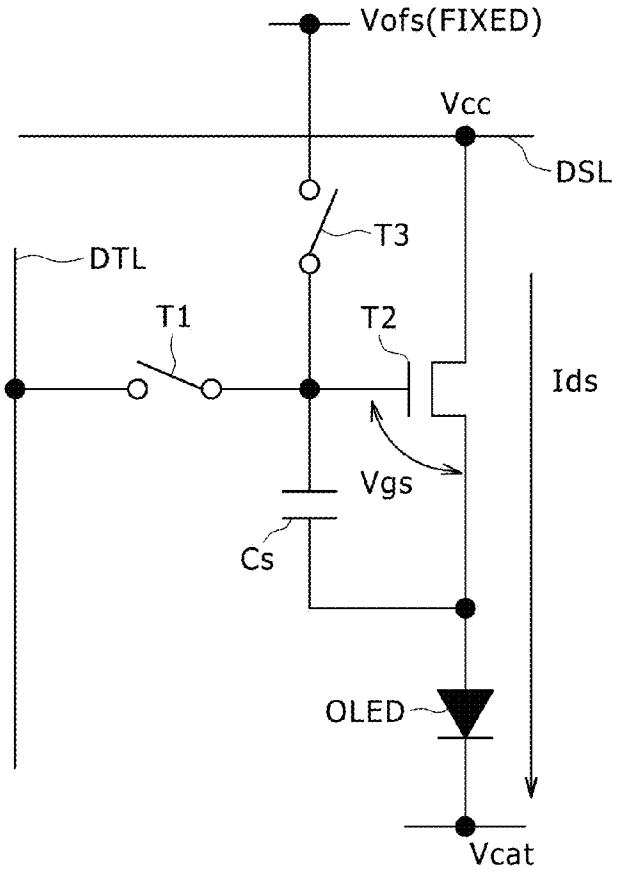
FIG. 32 is a diagram of assistance in explaining a state of operation of the pixel circuit.

First, conditions of operation within the pixel circuit in an emission state are shown in FIG. 32. At this time, a sampling transistor T1 is in an off state. Meanwhile, the driving transistor T2 operates in a saturation region, and a current Ids determined according to a gate-to-source voltage Vgs flows (FIGS. 31A to 31E (t1)).

Conditions of operation in a non-emission state will next be described. At this time, the potential of the power supply line DSL changes from the high potential Vcc to the low potential Vss (FIGS. 31A to 31E (t2)). At this time, when the low potential Vss is lower than a sum of a threshold value Vthel and a cathode potential Vcath of an organic EL element, that is, when $Vss<Vthel+Vcath$, the organic EL element OLED is quenched.

Figure 33:
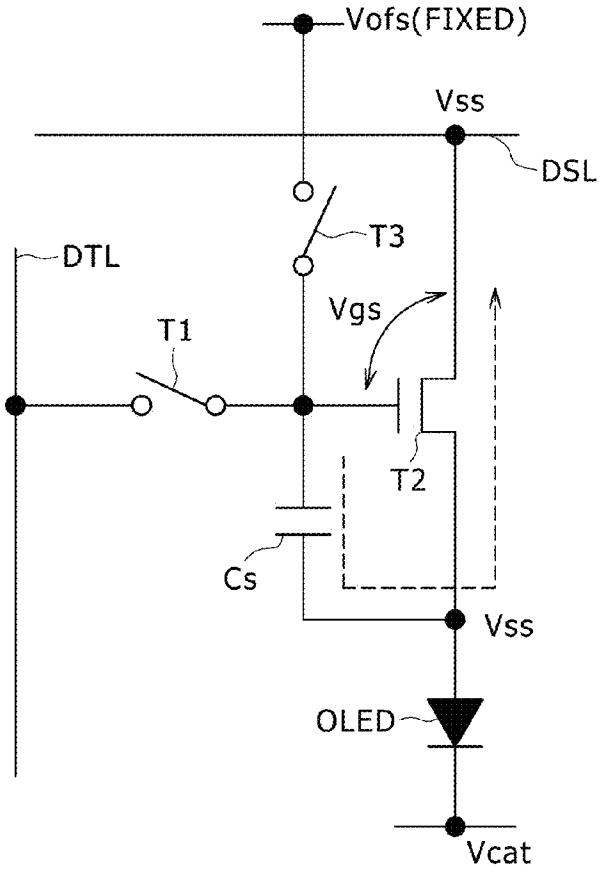
FIG. 33 is a diagram of assistance in explaining a state of operation of the pixel circuit.

Incidentally, the source potential Vs of the driving transistor T2 becomes equal to the potential of the power supply line DSL. That is, the anode electrode of the organic EL element is charged to the low potential Vss. FIG. 33 shows conditions of operation within the pixel circuit. As indicated by a broken line in FIG. 33, at this time, a charge retained by a storage capacitor Cs is taken out to the power supply line DSL.

Thereafter, the second sampling transistor T3 is controlled to be turned on by the offset line driving section 53. The gate potential of the driving transistor T2 is thereby changed to the offset voltage Vofs (FIGS. 31A to 31E (t3)).

Figure 34:
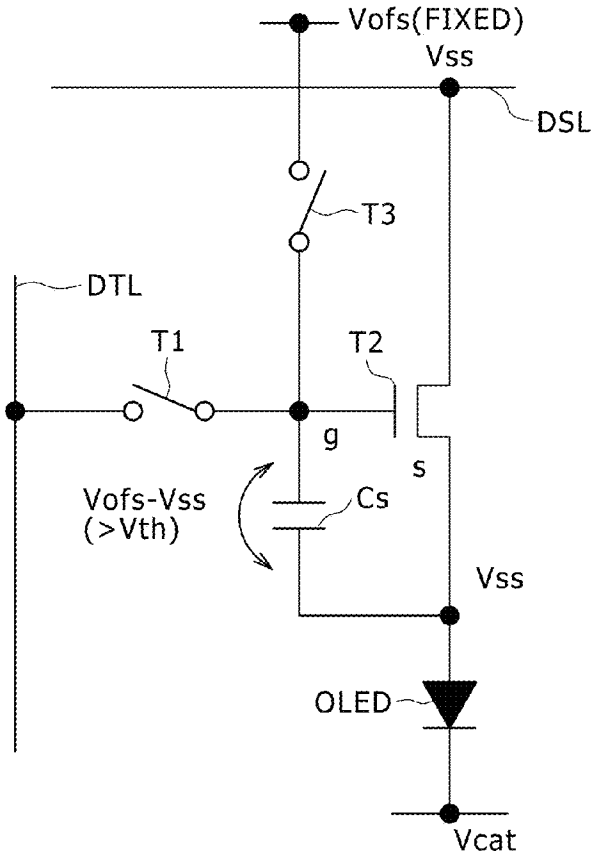
FIG. 34 is a diagram of assistance in explaining a state of operation of the pixel circuit.

FIG. 34 shows conditions of operation within the pixel circuit in this case. At this time, the gate-to-source voltage Vgs of the driving transistor T2 is given by $Vofs-Vss$. This voltage is set larger than the threshold voltage Vth of the driving transistor T2. This is because threshold value correcting operation cannot be performed unless $Vofs-Vss>Vth$ is satisfied.

Next, the power supply potential of the power supply line DSL is changed to the high potential Vcc again (FIGS. 31A to 31E (t4)). Because the power supply potential of the power supply line DSL is changed to the high potential Vcc, the anode potential of the organic EL element OLED is given by the source potential Vs of the driving transistor T2.

Figure 35:
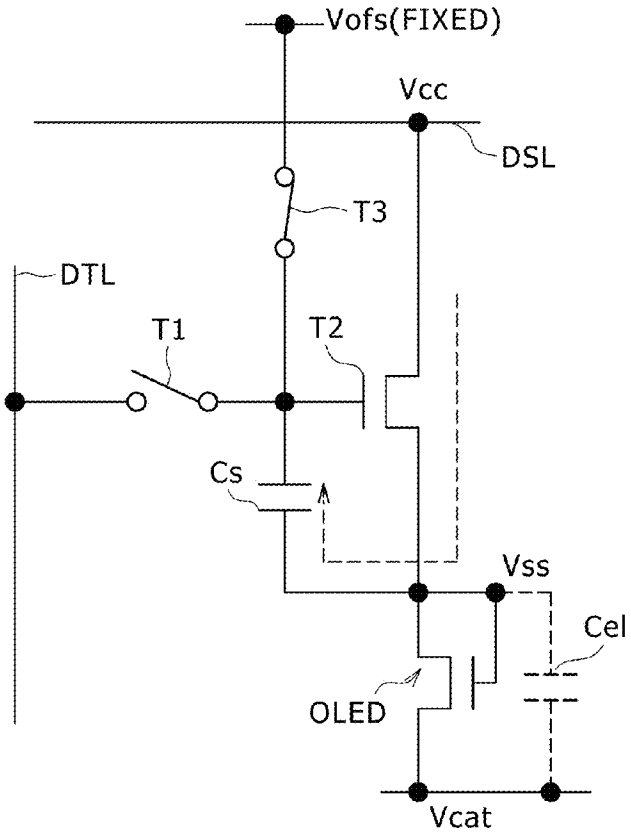
FIG. 35 is a diagram of assistance in explaining a state of operation of the pixel circuit.

FIG. 35 represents the organic EL element OLED by an equivalent circuit. That is, FIG. 35 shows the organic EL element OLED as a diode and a parasitic capacitance Cel. At this time, as long as a relation Vel≤Vcat+Vthel is satisfied (however, the leakage current of the organic EL element is considered to be considerably smaller than the driving current Ids flowing through the driving transistor T2), the driving current Ids flowing through the driving transistor T2 is used to charge the storage capacitor Cs and the parasitic capacitance Cel.

Consequently, the anode potential Vel of the organic EL element OLED rises with the passage of time. That is, the source potential Vs of the driving transistor T2 starts rising with the gate potential of the driving transistor T2 fixed at the offset potential Vofs.

The gate-to-source voltage Vgs of the driving transistor T2 eventually converges to the threshold voltage Vth. At this time, Vel=Vofs−Vth≤Vcat+Vthel is satisfied.

Figure 36:
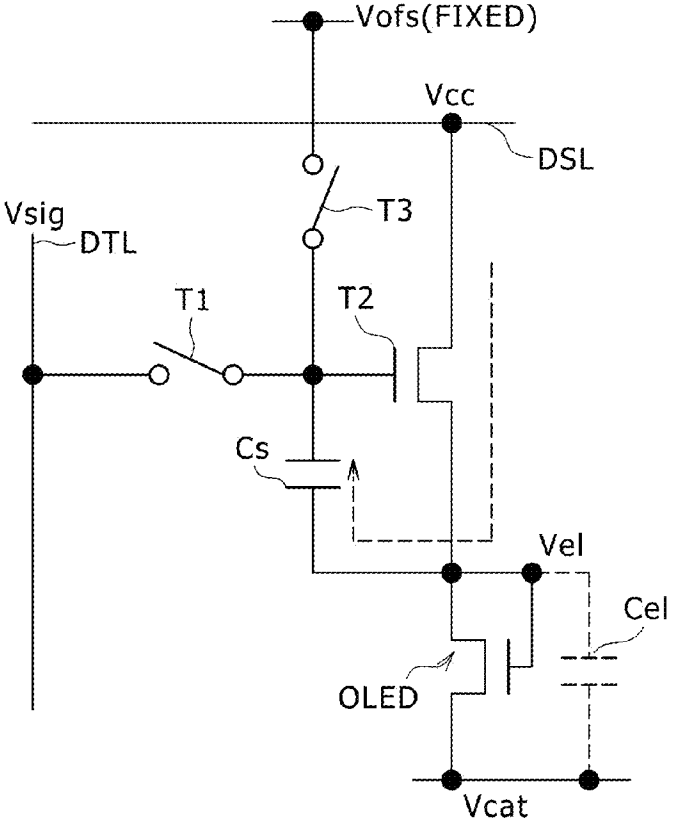
FIG. 36 is a diagram of assistance in explaining a state of operation of the pixel circuit.

When the threshold value correcting period is ended, the second sampling transistor T3 is controlled to be off again (FIGS. 31A to 31E (t5)). FIG. 36 shows conditions of operation within the pixel circuit in this case.

Figure 37:
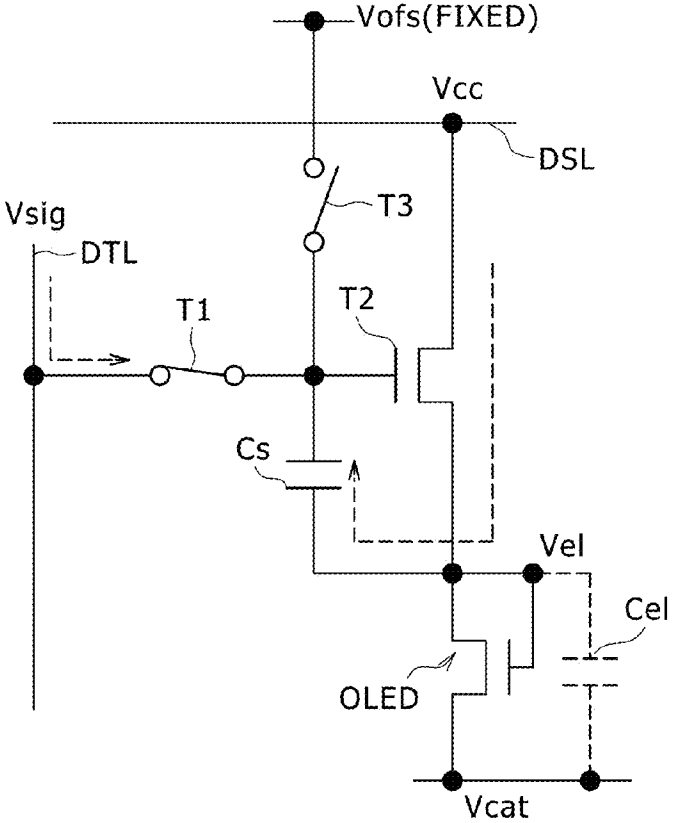
FIG. 37 is a diagram of assistance in explaining a state of operation of the pixel circuit.

Thereafter, the first sampling transistor T1 is controlled to be in an on state after timing necessary for the potential of the signal line DTL to make a transition to a signal potential Vsig (FIGS. 31A to 31E (t6)). FIG. 37 shows conditions of operation within the pixel circuit in this case. The signal potential Vsig is given according to the gradation value of the corresponding pixel.

At this time, the gate potential Vg of the driving transistor T2 makes a transition to the signal potential Vsig. Meanwhile, the source potential Vs of the driving transistor T2 is raised with time by a current flowing from the power supply line DSL to the storage capacitor Cs.

At this time, unless the source potential Vs of the driving transistor T2 exceeds a sum of the threshold voltage Vthel and the cathode voltage Vcat of the organic EL element (the leakage current of the organic EL element is considered to be considerably smaller than the current flowing through the driving transistor T2), the driving current Ids supplied by the driving transistor T2 is used to charge the storage capacitor Cs and the parasitic capacitance Cel.

Incidentally, because the threshold value correcting operation of the driving transistor T2 is already completed, the driving current Ids fed by the driving transistor T2 has a value reflecting the mobility μ of the driving transistor T2. Specifically, the higher the mobility μ of the driving transistor, the larger the driving current Ids flowing through the driving transistor, and the more rapidly the source potential Vs rises. Conversely, the lower the mobility μ of the driving transistor, the smaller the driving current Ids flowing through the driving transistor, and the more slowly the source potential Vs rises.

Consequently, the voltage retained by the storage capacitor Cs is corrected according to the mobility μ of the driving transistor T2. That is, the gate-to-source voltage Vgs of the driving transistor T2 is changed to a voltage corrected for the mobility μ.

Figure 38:
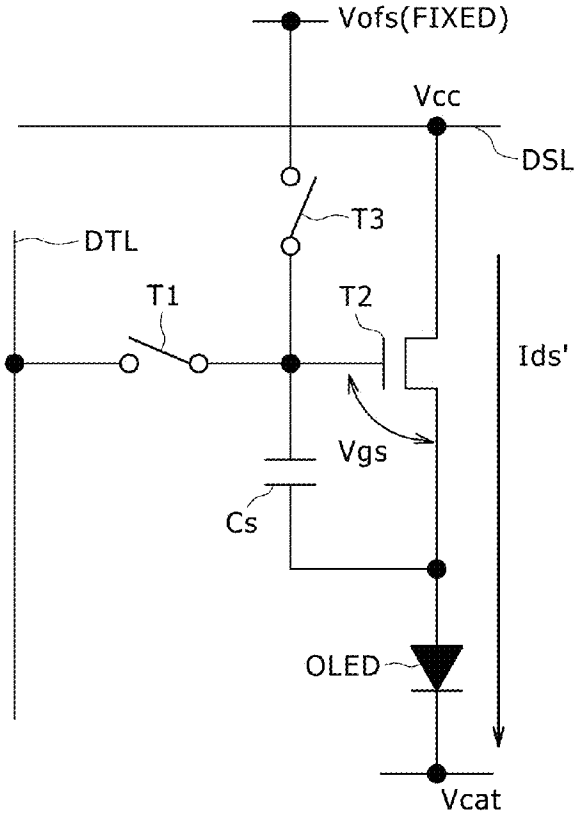
FIG. 38 is a diagram of assistance in explaining a state of operation of the pixel circuit.

Finally, when the first sampling transistor T1 is controlled to be turned off and thereby the writing of the signal potential is ended, the emission period of the organic EL element OLED begins (FIGS. 31A to 31E (t7)). FIG. 38 shows conditions of operation within the pixel circuit in this case. Incidentally, the gate-to-source voltage Vgs of the driving transistor T2 is constant. Thus, the driving transistor T2 supplies a constant current Ids' to the organic EL element.

With this, the anode potential Vel of the organic EL element rises to a potential Vx at which the current Ids' is passed through the organic EL element. The light emission of the organic EL element is thereby started.

Also in the case of the driving circuit proposed in the present embodiment, the I-V characteristic of the organic EL element OLED changes as the emission period becomes longer.

That is, the source potential Vs of the driving transistor T2 also changes. However, because the gate-to-source voltage Vgs of the driving transistor T2 is held constant by the storage capacitor Cs, the amount of the current flowing through the organic EL element OLED does not change. Thus, when the pixel circuit and the driving system proposed in the present embodiment are adopted, the driving current Ids corresponding to the signal potential Vsig can be made to continuously flow at all times irrespective of changes in the I-V characteristic of the organic EL element OLED. It is thereby possible to maintain the light emission luminance of the organic EL element OLED at a luminance corresponding to the signal potential Vsig.

(D-3) Product Examples

(a) Electronic Devices

The invention has been described above by taking an organic EL panel as an example. However, the above-described organic EL panel is also distributed in product forms in which the organic EL panel is mounted in various electronic devices. Examples of mounting the organic EL panel in other electronic devices will be shown below.

Figure 39:
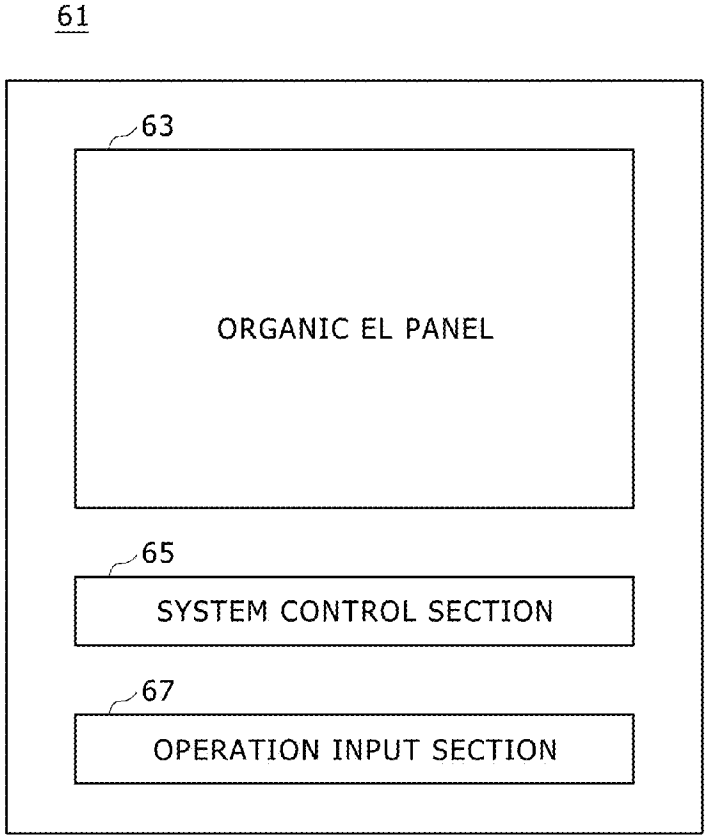
FIG. 39 is a diagram showing an example of conceptual configuration of an electronic device.

FIG. 39 shows an example of conceptual configuration of an electronic device 61. The electronic device 61 includes an organic EL panel 63 as described above, a system control section 65, and an operation input section 67. The description of processing performed by the system control section 65 differs depending on the product form of the electronic device 61. The operation input section 67 is a device for receiving an operation input to the system control section 65. For example, a switch, a button, or another mechanical interface, a graphical interface or the like is used as the operation input section 67.

It is to be noted that the electronic device 61 is not limited to a device in a specific field as long as the electronic device 61 has a function of displaying an image or video generated within the device or input externally.

Figure 40:
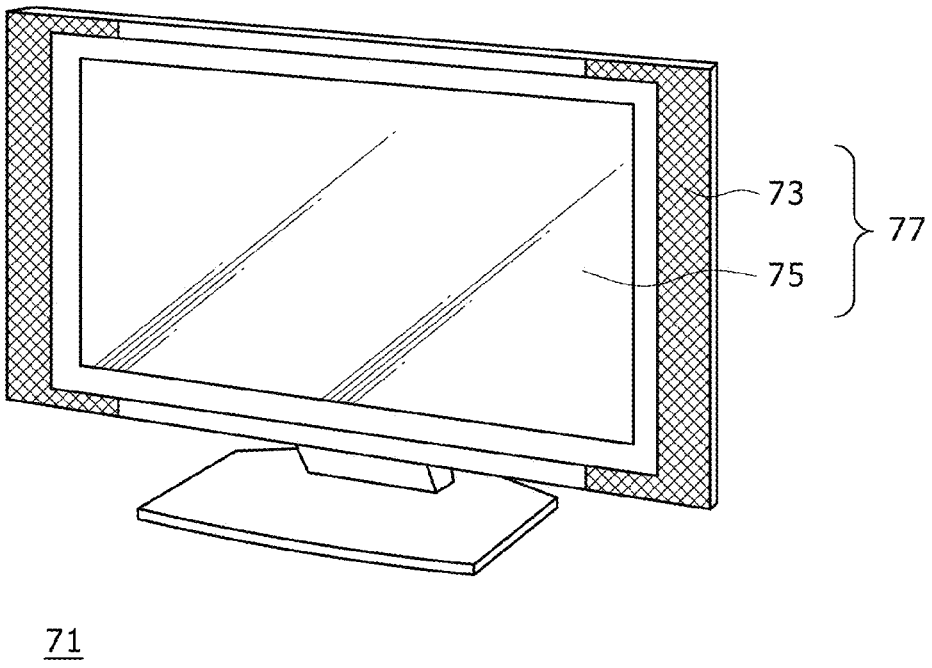
FIG. 40 is a diagram showing an example of a product of an electronic device.

FIG. 40 shows an example of external appearance of a television receiver as another electronic device. A display screen 77 composed of a front panel 73, a filter glass 75 and the like is disposed on a front surface of a casing of the television receiver 71. The part of the display screen 77 corresponds to the organic EL panel described in an embodiment.

Figure 41A:
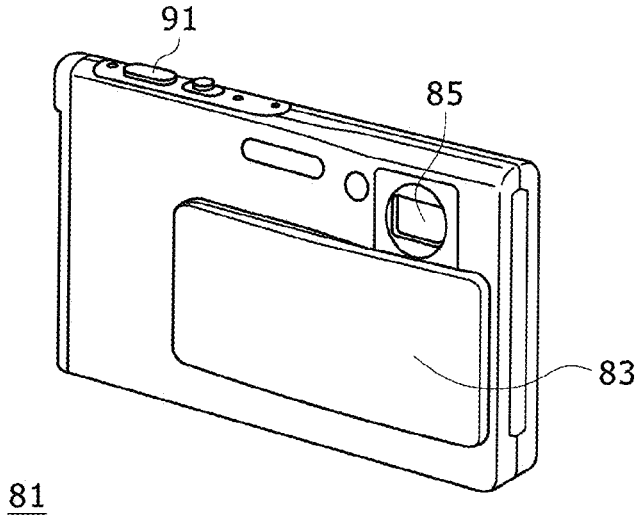
FIGS. 41A and 41B are diagrams showing an example of a product of an electronic device.
Figure 41B:
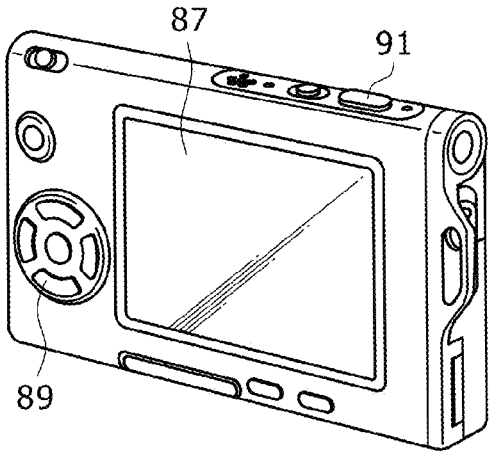

A digital camera, for example, is assumed as the electronic device 61 of this type. FIGS. 41A and 41B show an example of external appearance of the digital camera 81. FIG. 41A shows an example of external appearance of a front side (subject side). FIG. 41B shows an example of external appearance of a back side (photographer side).

The digital camera 81 includes a protective cover 83, an image pickup lens section 85, a display screen 87, a control switch 89, and a shutter button 91. Of these parts, the part of the display screen 87 corresponds to the organic EL panel described in an embodiment.

Figure 42:
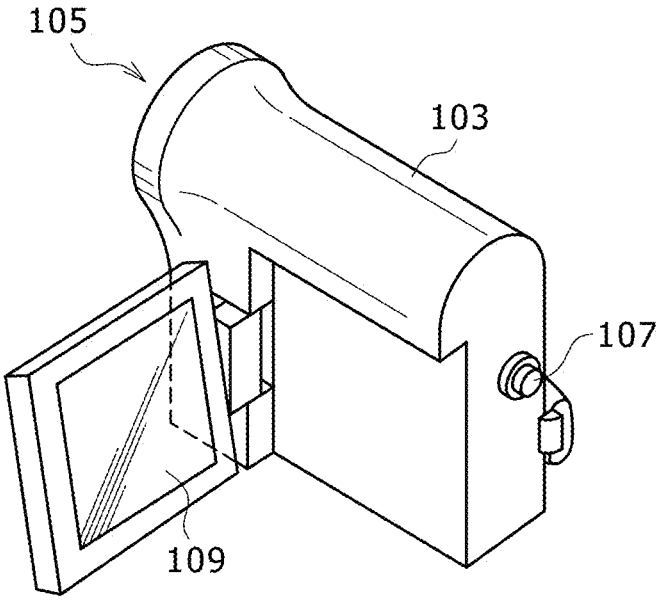
FIG. 42 is a diagram showing an example of a product of an electronic device.

A video camera, for example, is assumed as the electronic device 61 of this type. FIG. 42 shows an example of external appearance of the video camera 101.

The video camera 101 includes an image pickup lens 105 for picking up an image of a subject in the front of a main body 103, a picture taking start/stop switch 107, and a display screen 109. Of these parts, the part of the display screen 109 corresponds to the organic EL panel described in an embodiment.

Figure 43A:
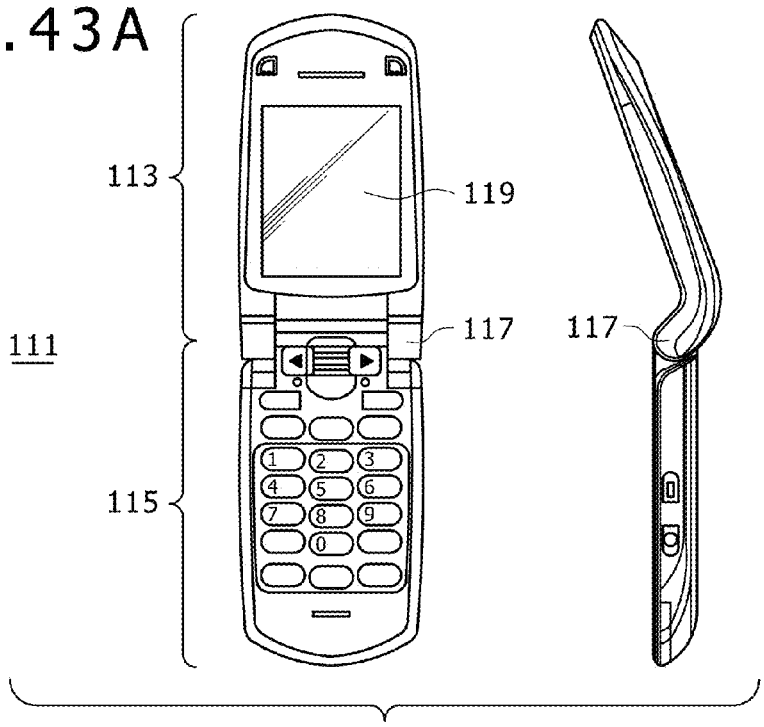
FIGS. 43A and 43B are diagrams showing an example of a product of an electronic device.
Figure 43B:
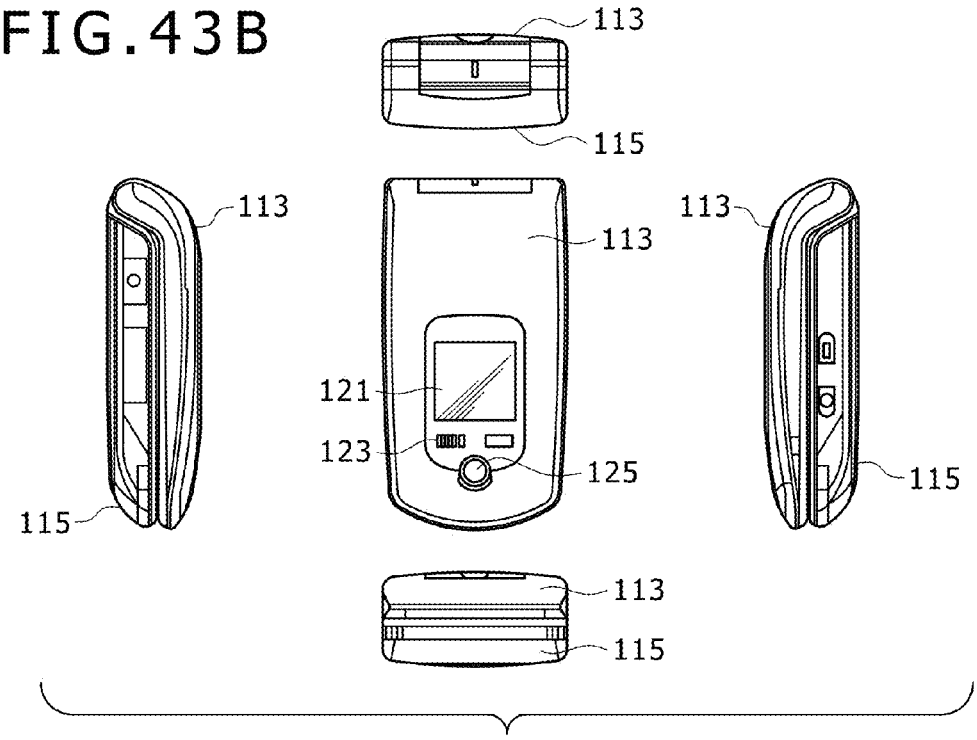

A portable terminal device, for example, is assumed as the electronic device 61 of this type. FIGS. 43A and 43B show an example of external appearance of a portable telephone 111 as a portable terminal device. The portable telephone 111 shown in FIGS. 43A and 43B is of a folding type. FIG. 43A shows an example of external appearance of a casing in an opened state. FIG. 43B shows an example of external appearance of the casing in a folded state.

The portable telephone 111 includes an upper side casing 113, a lower side casing 115, a coupling part (a hinge part in this example) 117, a display screen 119, an auxiliary display screen 121, a picture light 123, and an image pickup lens 125. Of these parts, the parts of the display screen 119 and the auxiliary display screen 121 correspond to the organic EL panel described in an embodiment.

Figure 44:
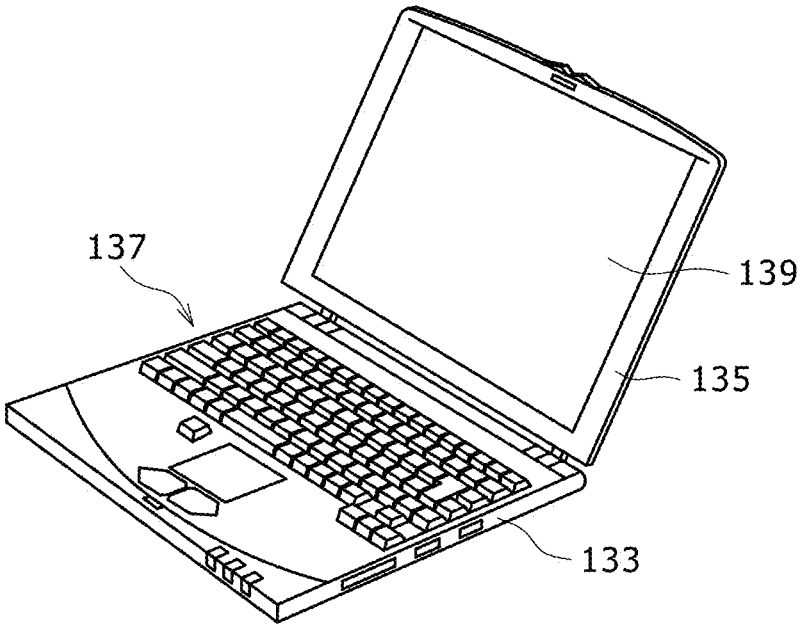
FIG. 44 is a diagram showing an example of a product of an electronic device.

A computer, for example, is assumed as the electronic device 61 of this type. FIG. 44 shows an example of external appearance of a notebook computer 131.

The notebook computer 131 includes a lower side casing 133, an upper side casing 135, a keyboard 137, and a display screen 139. Of these parts, the part of the display screen 139 corresponds to the organic EL panel described in an embodiment.

In addition to these examples, an audio reproducing device, a game machine, an electronic book, an electronic dictionary and the like are assumed as the electronic device 61.

(D-4) Other Display Device Examples

In the above-described embodiments, the invention is applied to an organic EL panel.

However, the above-described driving techniques are also applicable to other EL display devices. The above-described driving techniques are also applicable to for example a display device in which LEDs are arranged and a display device in which light emitting elements having another diode structure are arranged on a screen. The above-described driving techniques are also applicable to for example an inorganic EL panel.

(D-5) Others

Various examples of modification of the foregoing embodiments can be considered without departing from the spirit of the invention. In addition, various examples of modification and application created or combined on the basis of the description of the present specification can be considered.

What is claimed is:

1. A display device comprising:

a plurality of pixel circuits arranged in a display area; and driving circuitry configured to drive the pixel circuits, each of the pixel circuits including a first sampling transistor, drive transistor, a capacitor, a second sampling transistor and a light emitting element, the driving circuitry including write control circuitry configured to control operation of the first sampling transistor and the second sampling transistor, wherein the driving circuitry is configured to drive the pixel circuits by executing:

a first process to provide an offset potential through the second sampling transistor to the capacitor during a first period;

a second process to provide a current through the drive transistor to the capacitor at a beginning of a second period and while the first sampling transistor is sampling an image signal during the second period, the first process occurring before the second process; a third process to provide a driving current based on a voltage stored in the capacitor, to the light emitting element via the drive transistor during a third period, the second process occurring before the third process, wherein the second process begins when the first sampling transistor transitions from an off state to an on state, wherein a duration of the second period is defined by a period in which the first sampling transistor is in the on state, and wherein the write control circuitry includes a first write control circuit and a second write control circuit that drive the pixel circuits from both sides of the display area, the first and the second write control circuits being connected to the first sampling transistor and the second sampling transistor.

2. The display device according to claim 1, wherein the driving circuitry further includes a power supply control circuitry configured to control power supply for the drive transistors of the pixel circuits.

3. The display device according to claim 2, wherein the power supply control circuitry includes a first power supply control circuit and a second power supply control circuit, configured to drive the pixel circuits from both sides of the display area.

4. The display device according to claim 3, wherein the first and the second power supply control circuits are connected to the drive transistors of the pixel circuits.

5. The display device according to claim 2, wherein the power supply control circuitry is configured to supply pulse signal to power supply control lines connected to current nodes of the drive transistors of the pixel circuits.

6. A display device comprising:

a plurality of pixel circuits arranged in a display area;

a plurality of signal lines extending in a first direction;

a plurality of scanning lines extending in a second direction, the second direction being perpendicular to the first direction;

driving circuitry configured to drive the pixel circuits, each of the pixel circuits including a sampling transistor, drive transistor, a capacitor and a light emitting element, the driving circuitry including write control circuitry configured to control operation of the sampling transistor, wherein the driving circuitry is configured to drive each of the pixel circuits by executing:

a first process to provide a current through the drive transistor to the capacitor when the sampling transistor transitions from an off state to an on state and while the sampling transistor is sampling an image signal during a correction and sampling period, and a second process to provide a driving current based on a voltage stored in the capacitor, to the light emitting element via the drive transistor during an emission period, the first process occurring before the second process, wherein the write control circuitry includes:

a first write control circuit arranged on a first side of the display area; and a second write control circuit arranged on a second side of the display area which is opposite to the first side, wherein the first and the second write control circuits are connected to the sampling transistors of the pixel circuits via the scanning lines, and wherein the correction and sampling period begins when the write control circuitry changes a control signal on one of the scanning lines from a first potential to a second potential, the correction and sampling period ending when the write control circuitry changes the control signal from the second potential to the first potential.

7. The display device according to claim 6, wherein the driving circuitry further includes a power supply control circuitry configured to control power supply for the drive transistors of the pixel circuits.

8. The display device according to claim 7, wherein the power supply control circuitry includes:

a first power supply control circuit arranged on the first side of the display area; and a second power supply control circuit arranged on the second side of the display area.

9. The display device according to claim 8, wherein the first and the second power supply control circuits are connected to the drive transistors of the pixel circuits.

10. The display device according to claim 7, further comprising a plurality of power supply control lines extending in the second direction, wherein the power supply control circuitry is configured to supply pulse signal to the power supply control lines connected to current nodes of the drive transistors of the pixel circuits.

11. The display device according to claim 7, further comprising a plurality of power supply control lines extending in the second direction, wherein the power supply control circuitry includes a plurality of buffer transistors respectively connected to each of the power supply control lines.

12. The display device according to claim 11, wherein a direction of a channel length of each of the buffer transistors is parallel to the first direction.

13. The display device according to claim 11, wherein a channel width for each of the buffer transistors is larger than length of one pixel in a direction of the signal line.

14. The display device according to claim 8, wherein the first write control circuit is arranged between the first power supply control circuit and the display area, and the second write control circuit is arranged between the second power supply control circuit and the display area.

15. The display device according to claim 14, wherein the first power supply control circuit is connected to one of the power supply control lines through, in this order:

a first wiring including a first material and formed on a first layer;

a second wiring including a second material formed on a second layer; and a third wiring including the first material and formed on the first layer.

16. The display device according to claim 15, wherein the second wiring is extending through the second direction and overlapping with a power supply line for the first write control circuit, the power supply line being extending through the first direction.

17. The display device according to claim 15, wherein the first material is different from the second material.

18. The display device according to claim 17, wherein the first material is aluminum and the second material is molybdenum.

19. The display device according to claim 16, wherein the power supply line includes the first material and formed on the first layer.

20. A display device comprising:

a plurality of pixel circuits arranged in a display area;

a plurality of signal lines extending in a first direction;

a plurality of scanning lines extending in a second direction, the second direction being perpendicular to the first direction;

driving circuitry being configured to drive the pixel circuits, each of the pixel circuits including:

a light emitting element;

a first transistor;

a capacitor configured to receive a voltage signal via the first transistor; and a second transistor configured to provide a driving current for the light emitting element in response to a voltage stored in the capacitor, wherein the driving circuitry includes:

a scanning control circuit configured to control operation of the first transistor, and a power supply control circuit configured to control power supply for the second transistor, wherein the power supply control circuit includes a plurality of buffer transistors each respectively connected to a power supply control line, and wherein a direction of a channel length of each of the buffer transistors is parallel to the first direction, and wherein a channel width for each of the buffer transistors is larger than length of one pixel in a direction of the signal line.

* * * * *